US009513079B1

(12) United States Patent
Missel

(10) Patent No.: US 9,513,079 B1
(45) Date of Patent: Dec. 6, 2016

(54) UNCONVENTIONAL COMPACT COMPOUND BOW

(71) Applicant: Jonathan William Missel, Honeoye Falls, NY (US)

(72) Inventor: Jonathan William Missel, Honeoye Falls, NY (US)

( * ) Notice: Subject to any disclaimer, the term of this patent is extended or adjusted under 35 U.S.C. 154(b) by 0 days.

(21) Appl. No.: 14/925,160

(22) Filed: Oct. 28, 2015

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/0094
See application file for complete search history.

(56) References Cited

U.S. PATENT DOCUMENTS

| | | | | |
|---|---|---|---|---|
| 2,982,279 | A * | 5/1961 | Pursley | F41B 5/1469 124/23.1 |
| 3,055,353 | A * | 9/1962 | Perrucci | F41B 5/0005 124/24.1 |
| 4,457,287 | A * | 7/1984 | Babington | F41B 5/10 124/23.1 |
| 4,603,676 | A * | 8/1986 | Luoma | F41B 5/1469 124/25 |
| 4,957,093 | A | 9/1990 | Hamlett | |
| 4,976,250 | A * | 12/1990 | Jeffrey | F41B 5/10 124/25 |
| 5,243,957 | A * | 9/1993 | Neilson | F41B 5/10 124/25.6 |
| 6,371,098 | B1 | 4/2002 | Winther | |
| 6,715,481 | B1 * | 4/2004 | Anderson | F41B 5/10 124/23.1 |
| 6,729,320 | B1 | 5/2004 | Terry | |
| 7,066,165 | B2 | 6/2006 | Perry | |
| 7,743,760 | B2 * | 6/2010 | Woodland | F41B 5/0094 124/25 |
| 8,622,050 | B2 | 1/2014 | Goff et al. | |
| 8,656,899 | B2 | 2/2014 | Bednar et al. | |
| 8,776,770 | B2 | 7/2014 | Batdorf | |
| 8,991,380 | B2 | 3/2015 | Bednar et al. | |
| 2013/0042848 | A1 | 2/2013 | Trpkovski | |
| 2013/0112182 | A1 * | 5/2013 | Martin | F41B 5/10 124/23.1 |
| 2014/0238372 | A1 | 8/2014 | Chirico | |
| 2015/0153131 | A1 | 6/2015 | Trpkovski | |

* cited by examiner

*Primary Examiner* — Melba Bumgarner
*Assistant Examiner* — Amir Klayman
(74) *Attorney, Agent, or Firm* — Triangle Patents, PLLC

(57) ABSTRACT

The device of the present invention employs a riser, bow limbs, and bowstring to shoot an arrow. The employed features are positioned horizontally relative to the ground and generally perpendicular to the device handle when in use. The device handle may be hinged, and is hinged in the same plane as the riser, bow limbs, and bowstring. The device handle is ambidextrous and may include an arm brace. The device handle may be adjusted to alter draw length, and the device limb pockets may be adjusted to alter draw weight. The device is completely user-adjustable, compact, and lightweight.

16 Claims, 16 Drawing Sheets

UNCONVENTIONAL COMPACT COMPOUND BOW

BACKGROUND OF THE INVENTION

1. Field of the Invention

The present invention is generally directed to mechanical projectors, more specifically bows, compound bows, and compact compound bows.

2. Description of the Prior Art

Generally, it is known in the prior art for a compound bow to have a structural riser with attached flexible limbs and a cam pulley system with cables and a bowstring, wherein the archer holds a handle mounted to the riser in one hand and draws the bowstring with the other hand. The drawing of the bowstring rotates the cams, which reels in the cables causing the limbs to flex and store potential energy. Upon release of the bowstring, the potential energy in the limbs is transferred to an arrow mounted to the bowstring and converted to kinetic energy as the arrow is propelled forward.

U.S. Pat. No. 4,957,093 for compound bow having a pistol grip by inventor Hamlett filed Jul. 19, 1989 and issued Sep. 18, 1990 is directed to a compound bow including a rigid central body portion having an arrow window recess in one side and a pair of bow limbs fixedly mounted to the front of the body. The central body portion is pivotally mounted to a support assembly for limited floating pivotal movement of the general plane of the bow limbs, bowstring and arrow axis relative to the hand grip member. The hand grip member has a pistol grip and arm support, the grip being mountable at any of several positions along the fore and aft axis of the support assembly for adjustment of the draw length without the necessity of changing pulleys or arrow length. The pivotal float between the support assembly and the bow plane eliminates misaligning torques placed on the arrow allowing greatly increased accuracy. A modified version of the compound bow comprises a frame including a body portion and two tensionable, planar arms extending therefrom, at least two pulleys mounted on the frame, a grip asymmetrically mounted on the body portion and projecting from one side thereof and a forearm support mounted on the body portion which, when the grip is grasped by an archer, cooperates with the grip to help steady the body. When in use, the bow is held at a substantial angle with reference to the vertical.

U.S. Pat. No. 6,371,098 for split limb compact archery bow by inventor Winther filed Aug. 28, 2000 and issued Apr. 16, 2002 is directed to a compound or recurve bow that has split limbs mounted to limb pockets, which are on pivots connected to a handle riser, wherein the riser provides an arrow slot between the upper limbs so the arrow is launched from between the upper limbs. The result is an effective compound or recurve archery bow that is more compact and comparatively lighter than heretofore known.

U.S. Pat. No. 6,729,320 for shoot through bow string arrangement for an archery bow by inventor Edgell filed May 21, 2003 and issued May 4, 2004 is directed to an archery bow including a riser having a sight plane associated therewith; a pair of flexible limbs extending oppositely from the riser, with each limb having a distal end; and a pair of rotating members pivotally coupled to a respective distal end. A rotation controller includes a first saddle and a first string having opposite ends. The first string wraps the first saddle and the opposite ends are connected to a distal end of one of the limbs. The first string is located on opposite sides of the sight plane. A shoot through window includes a second saddle, a third saddle, and a second string wrapping each of the second saddle and the third saddle. The second string is located on opposite sides of the sight plane.

U.S. Pat. No. 7,066,165 for center-fire bow by inventor Perry filed Aug. 18, 2004 and issued Jun. 27, 2006 is directed to a bow including a bow frame with a geometric center, and a window surrounding the geometric center. A bow handle is attached to the bow frame at a position offset from the geometric center, such that a user can fire an arrow through the window, through the geometric center of the bow. A gimbal may be disposed within the window, the bow handle being pivotally attached to the gimbal, so as to allow free pivoting of the bow about two substantially orthogonal axes.

U.S. Pat. No. 8,622,050 for line crossbow conversion kit and hybrid compound bow by inventors Goff and Goff filed May 27, 2011 and issued Jan. 7, 2014 is directed to a kit to convert a compound archery bow into a left or right handed inline (vertical limb) crossbow. The conversion kit includes a mounting plate attachable to a side of the bow riser section to hold a socket to receive a draw-lock bar which can be removed for take-down and storage. The draw-lock bar has a series of laterally spaced bolt holes to attach a grip with a trigger release latch assembly at a selectable draw length. The bar can be rotated and attached to either side of the bow, and the trigger and grip can be reposition within the trigger housing for left, right or horizontal shooting. The string latch assembly has an anti-dryfire lever that is only moved from the blocking position when an arrow is nocked. The kit also provides a hinged cocking stirrup, and a front hand vertical grip on the riser side opposite the draw-bar socket. Also disclosed is a dedicated hybrid compound bow for dedicated use with kit as an inline or traditional crossbow. The hybrid compound bow is made especially. The hybrid bow has no forehand grip, and has a shoot through riser to provide vertical and horizontal centering of the arrow to the string.

U.S. Pat. No. 8,656,899 for barrel cable suppressor by inventors Bednar and Hout filed Jan. 5, 2011 and issued Feb. 25, 2014 is directed to a crossbow comprising a main beam, a trigger mechanism, a bow assembly, and a barrel cable suppressor. First and second cables may pass through a cable slot formed in a barrel member. The first and second cables may be received by first and second cams respectively such that the rotation of the first and second cams in a first direction causes the first and second limbs to be pulled generally inward towards the main beam. The barrel cable suppressor may be positioned at least partially within the cable slot and may at least partially suppresses vibrations and noise caused by the first and second cables when the bowstring is released from the trigger mechanism.

U.S. Pat. No. 8,776,770 for bow with adjustable limbs by inventor Batdorf filed Jul. 22, 2011 and issued Jul. 15, 2014 is directed to archery bow adjustment systems that enable adjustment of both the draw weight and the brace height of the bow. The adjustment system includes a plate mounted on an end of a riser of the bow. The plate supports a limb of the bow and is adjustably positionable relative to the riser.

U.S. Pat. No. 8,991,380 for barrel cable suppressor by inventors Bednar and Hout filed Feb. 24, 2014 and issued Mar. 31, 2015 is directed to a grip guard used with a crossbow that has a main beam including a stock and a barrel. The grip guard may have a first wall that is positioned between the stock and the barrel and a second wall that extends outwardly from the main beam. The first wall may have dampening properties to attenuate sounds and vibrations caused by firing the crossbow and the second wall may prevent a user's fingers from inadvertently extending from the handle toward the barrel.

US Patent application 2013/0042848 for dual inverted limb by inventor Trpkovski filed May 25, 2012 and published Feb. 21, 2013 is directed to a bow adapted to shoot a projectile along a direction of flight. The bow includes a riser, a first limb, a second limb, and a drawstring. The riser extends perpendicular to the direction of flight. The riser includes a first mount adjacent a first end and a second mount adjacent a second end of the riser. The first and the second limbs extend along first and second contours from a proximal end to a distal end. The first limb is mounted to the first mount of the riser. The first contour includes a first attachment segment positioned adjacent the first mount. The second limb is mounted to the second mount of the riser. The second contour includes a second attachment segment positioned adjacent the second mount. The drawstring is operably connected to the first and the second limbs adjacent the distal ends. The first and the second attachment segments at least partially extend in the direction of flight from the proximal end to the distal end of the corresponding attachment segment.

US Patent application 2014/0238372 for hybrid compound bow slingshot with ammo receiver and hinged handle by inventor Chirico filed Jan. 16, 2014 and published Aug. 28, 2014 is directed to a hybrid compound bow slingshot. The device utilizes a riser, bow limbs and string that are positioned in a plane perpendicular to the device handle such that the riser, bow limbs and string are horizontally disposed relative to the ground when in use. The handle may be hinged, and is hinged in the same plane as the riser, bow limbs and string. The device may include an arm brace that is offset to the vertical centerline of the handle, and the arm brace may be adjusted for left-handed or right-handed shooters. The device may be used with arrows, and may be configured to utilize shot with an ammo receiver positioned in the string.

US Patent application 2015/0153131 for compact compound bow by inventor Trpkovski filed Dec. 1, 2014 and published Jun. 4, 2015 is directed to a compact compound bow. In various embodiments, the compact compound bow includes a first riser plate and a second riser plate. The bow can further include a first limb and a second limb, the first limb and second limb can be coupled to the first riser plate and the second riser plate. The bow can further include a re-locatable handle configured to be coupled to at least one of the first riser plate or the second riser plate in a first position and coupled to at least one of the first riser plate or the second riser plate in a second position. The re-locatable handle can be rotated 180 degrees from the first position to the second position.

The prior art is limited regarding compound bows including handles that are not built into the riser and, thus, adjust to fit the archer, pivot about an axis parallel to the undrawn bowstring to eliminate torqueing, reduce vibration transferred to the archer's bow-hand, and are ambidextrous. The prior art is further limited regarding handles affixed with an arm brace and a riser that allow arrows an arrow to pass through its geometric center.

SUMMARY OF THE INVENTION

The present invention is generally directed to mechanical projectors. The invention is further directed to a compound bow. Further still, the invention is directed to a compound bow that shoots in a generally horizontal plane, similar to a crossbow but with compound bow features and functions.

The present invention is further directed to a mechanical projectile device comprising a structural riser, a pair of flexible structural limbs, and a handle, wherein the pair of structural limbs is adjustably affixed to the structural riser, the handle is adjustably, pivotally affixed to the structural riser, and the pair of structural limbs and the handle cooperate to adjust a draw weight and a draw length of the mechanical projectile device.

These and other aspects of the present invention will become apparent to those skilled in the art after a reading of the following description of the preferred embodiment when considered with the drawings, as they support the claimed invention.

DETAILED DESCRIPTION

Figure 1:
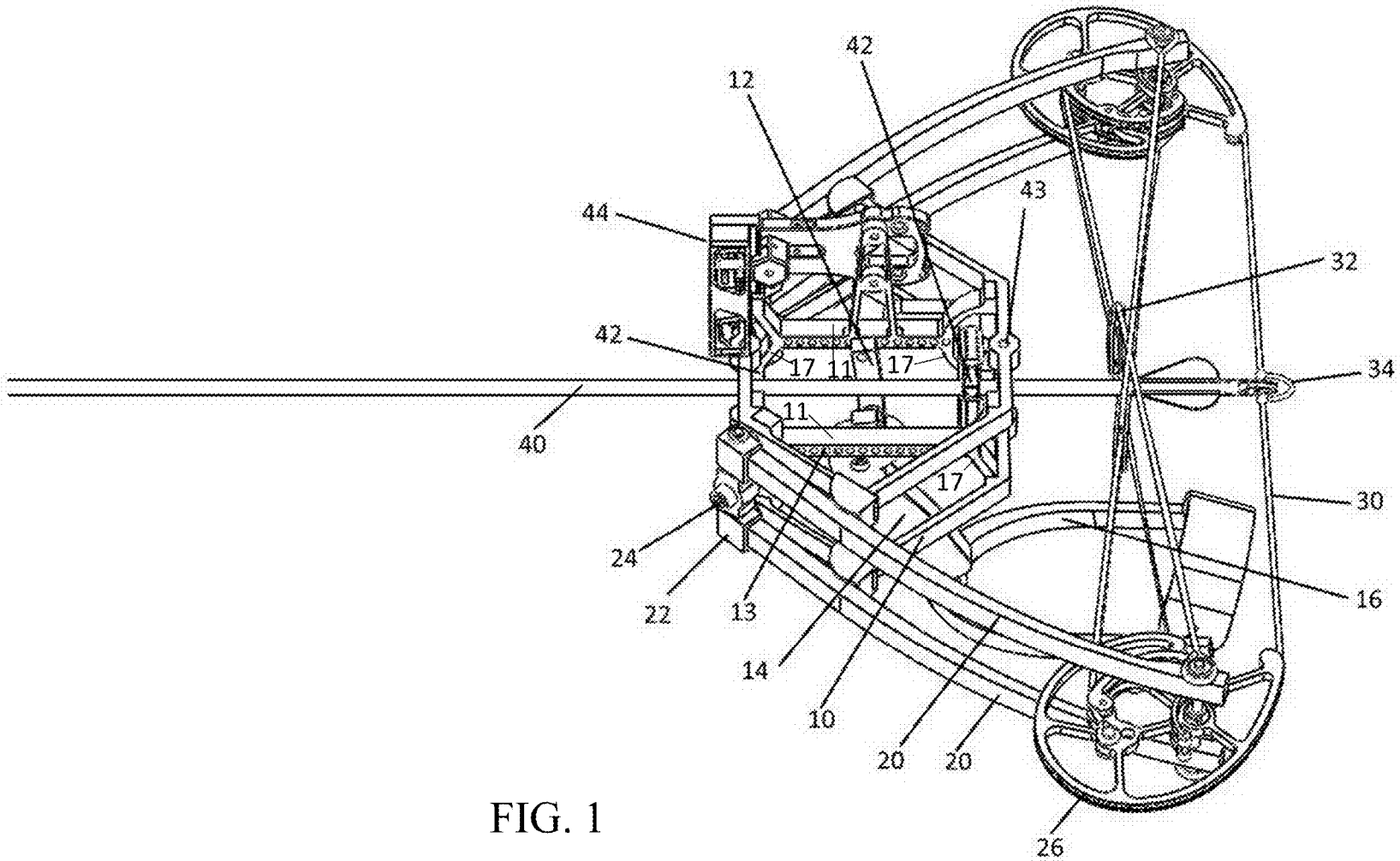
FIG. 1 illustrates a full, top-left perspective view image of the present invention.

The present invention is generally directed to mechanical projectors, specifically compound bows. The present invention includes a compound bow disposed in a generally horizontal plane, parallel to the ground, wherein the compound bow includes a structural riser, limbs, cam pulleys, cables, and a bowstring to form the projecting functional units of the compound bow. Further included are a handle, arm brace, arrow rest mounts, and sight mounts.

In a preferred embodiment, the main body of the present invention consists of two open-frame, structural members, or riser plates, that are horizontal and parallel to each other. In one embodiment, the structural members or riser plates are polygonal. In another embodiment wherein the structural members or riser plates are polygonal, each structural member is generally hexagonal in shape, wherein when viewed with an edge on bottom, there are four interior vertices and two exterior vertices. At each of the four interior vertices, a short, vertical structural member is affixed between the two horizontally parallel hexagonal structural members. In one embodiment, linear horizontal structural member, herein termed a pivot bar, is mounted by mounting brackets at each end to the riser plates at each interior corner and extends between the short, vertical structural members such that two exterior triangles and one interior rectangle are created within the hexagon. Disposed between the two horizontally parallel hexagonal structural members is an arrow rest. On both the front edge and the back edge of both horizontal structural members are mounts, wherein the mounts removably, adjustably provide optional mounting points for accessories such as sights, scopes and arrow rests, wherein the back edge is toward the archer. Disposed between the two structural cross members (in one embodiment, exterior triangles within the interior rectangle of the horizontally parallel hexagonal structural member) is an ambidextrous handle, wherein the top end of the handle is adjustable between the front edge and the back edge of the horizontally parallel hexagonal structural member along the linear horizontal structural member (pivot bar) through an array of selectable mounting points, preferably two mounting points. Preferably, the handle attachment or yoke is U-shaped to allow clearance for a projectile. The axle hole in the yoke is offset by ¼ the distance between the adjustable handle mounting holes. This doubles the resolution of the adjustable handle by having the option to flip it around. In a preferred embodiment, the adjustment holes are spaced ¼" apart and the yoke hole is offset by 1/16", making the effective draw-length adjustment resolution ⅛". Affixed to the bottom end of the handle is an arm brace. The arm brace strap can be adjusted to accommodate various sizes. The structure of the arm brace can be secured at any angle in the plane whose normal is the general axis of the handle to accommodate arm position. In one embodiment, the arm brace is secured using a screw. Preferably, the arm brace can be adjusted by loosening the screw, moving the arm brace to the desired position, and re-securing the screw. Adjustably affixed parallel to a front half edge of each exterior triangle and to each of the horizontally parallel hexagonal structural members are long, linear, flexible members that are parallel to each other and at the same distance as the horizontally parallel hexagonal structural member to which they are affixed. Rotationally affixed at the opposite end of and between the long, linear, flexible members are cam pulleys, which are connected by a linear, flexible, high-gauge, braided member, which is wrapped around at least a portion of both cam pulleys.

In a preferred embodiment, the riser plates are secured to each other by two sets of multifunctional crossmembers. One set serves to affix the riser plates and mount the limb pockets via the limb adjustment screws. The second set serves to affix the riser plates, provide structural rigidity to the open framed riser plates, and provide mounting points options for the handle and accessories. Disposed along the riser plates, at each of the four intersections with the vertical plane of symmetry, are optional mounting point options for accessories, such as sights, scopes, arrow rests, ballast weights, etc. These accessories may also be mounted to the adjustable handle mount members, either directly, or indirectly, through brackets.

The space between the riser plates, in cooperation with an arrow rest, provide for an opening through which an arrow may be shot. This general riser configuration is known as a shoot-through riser in the prior art; however, no prior art reveals a shoot-through riser between a double-sided, open-frame riser, like that of the present invention, namely a horizontally parallel structural member. U.S. Pat. No. 7,066,165 provides a shoot-through window, and U.S. Pat. No. 8,622,050 provides a shoot-through riser; however, neither design employs the shoot-through riser for horizontal, non-crossbow configurations. Additionally, neither patent lends itself to firing the arrow through the true geometric center of the functional bow. The present invention cooperates with an accessory arrow rest which holds the arrow directly centered. Providing a shoot-through riser system with a double-sided, open-frame design, like the present invention, affords more equally and symmetrically distributed transmission of force upon shooting for maximum accuracy, energy transfer efficiency and projectile speed. The riser design has several optional arrow rest mounting points, including the front or the back of the riser, so significantly different arrow lengths can be shot. Though all serve the purpose of affixing an arrow rest that centers the arrow, the variety of mounting options suite many different arrow rest types, as well as locations, to accommodate a wide range of arrow lengths. This adaptive design is meant to support the personal preferences of the user.

The prior art reveals slight adjustments for arrow rests, to aid in the tuning of the bow; however, the prior art does not teach forward/backward adjustment or multiple options for mounting locations, namely because no prior art provides a riser that allows for significant adjustments similar to that of the present invention.

The double-sided, open-frame riser in coordination with a centered arrow rest is perfectly symmetrical, allowing for the transfer of force from bowstring to limbs to riser to be evenly distributed across the riser. The forces act largely in the plane of the riser plate members, efficiently reducing the torsional structural stresses present in traditional cut-away riser, and allowing for a very lightweight design. The symmetry of the double-sided riser also reduces uneven limb deflection and cam lean, affording a more uniform distribution of energy transfer and improved accuracy when firing. The shape of the double-sided, open-frame riser, compared to the traditional linear riser of a compound bow, is more resistant to deflection from the forces applied to it during shooting. The shape reduces structural demands on the riser, thereby reducing the need for structural reinforcement in the riser and/or limbs, allowing for thinner members, and making the overall bow much lighter weight. Preferably, the riser of the present invention is made of aluminum. Alternatively, the riser is made any suitable composite, such as carbon fiber, or a metal with high strength-to-weight ratio. The single, linear riser of a traditional compound bow may bend or break with too much force or continual force—fatigue; thus, traditional compound bows need substantial reinforcement. The closed-loop shape of the present invention is stronger and more enduring than straight riser of the prior art. No prior art directed to compound bows or crossbows, in fact, provides such a riser. Further, although prior art, such as U.S. Pat. No. 8,622,050 provides a double-sided riser, the riser does not have a wide, open-structure, footprint.

In an alternative embodiment, the horizontally parallel, double-sided riser may be any shape, for example and not limitation, triangular, pentagonal, or any combination thereof. The riser shape does not need to be a polygon, as its design should ultimately be dictated by the desired features, function and performance of the bow, for example: limb angle, axle-to-axle distance, and component mounting. Further, the principles of this invention do not necessitate a riser with a closed shape; in one embodiment, the riser may have an open shape or a partially open shape. In yet another embodiment, the horizontal riser may not be double-sided, albeit including a bore through which the arrow may be shot, preserving the shoot-through riser characteristics and functions. Similarly, the limbs may be solid, versus split.

The handle preferably is positioned to rotate in a vertical plane that intersects the arrow to provide for balanced grip. Mounting the handle off the riser, as such, has several advantages, including eliminating the need for an arm guard to protect the archer from the bowstring. The extended axel of the pivoting handle intersects the arrow perpendicularly. Handle mount adjustment is in the direction of the arrow, spanning a range between the front of the riser and the back. The drawn bow's mass is preferably balanced about the pivot of the handle. Balancing can typically be achieved with intentional configuration of the accessories, such as arrow rest and sights, but can also be achieved through ballast massed if desired. Further, the handle is completely ambidextrous and symmetrical relative to the riser; no adjustments are necessary for left- or right-handedness, unlike other ambidextrous handles in the prior art that require grip adjustments, for example, for complete ambidexterity. The arm brace can be rotated to fit the preference of the user, and these preferences frequently fall into two ranges, defined by handedness.

A ¼"×20 threaded hole is included under the handle or arm brace to fit a monopod, bipod or tripod. This provides an optional aid in steadying the projector while aiming. Alternatively, the arm brace may be rested directly on an object like a log, gun rail, tree branch or rock, to steady the device. Neither of these methods are present in the prior art for vertical bows. Further, the arm brace, including the brace support and brace pad, provide enhanced stabilization while holding and shooting the bow by counteracting the torque created when drawing the bow. If not for the arm brace, the draw weight of the bow would be severely limited by the strength of the wrist to counteract the torque created upon drawing the bow.

In a preferred embodiment, the handle pivots around a horizontal axis perpendicular to the length of the arrow. This pivoting is provided by the adjustment holes in the linear, horizontal structural cross members of the riser. Pivoting mechanically eliminates the ability of the archer to draw the bowstring out of plane from the flexing limbs—a classic and natural technique problem called "torqueing." By pivoting, and balancing the drawn bow about that pivot, the bowstring does not deflect in a direction normal to the plane of the riser and torqueing is reduced, or more preferably, effectively eliminated. Reduced or effectively eliminated torqueing creates a more efficient, consistent and accurate shot. Further, bowstring alignment with respect to the riser, limbs, cams and cables does not change no matter the shooting angle, as there is no torqueing. Further still, the pivot is mechanically designed in cooperation with the geometric center of the shoot-through riser to strategically eliminate torqueing.

Preferably, the angle between the handle and the horizontal plane of the riser is adjustable between about 160 degrees and about 0 degrees. In another embodiment, the angle between the handle and the horizontal plane of the riser is adjustable between about 85 degrees and about 5 degrees. In another embodiment, the angle between the handle and the horizontal plane of the riser is adjustable between about 80 degrees and about 10 degrees. In another embodiment, the angle between the handle and the horizontal plane of the riser is adjustable between about 75 degrees and about 15 degrees. In another embodiment, the angle between the handle and the horizontal plane of the riser is adjustable between about 70 degrees and about 20 degrees. In another embodiment, the angle between the handle and the horizontal plane of the riser is adjustable between about 65 degrees and about 25 degrees. In another embodiment, the angle between the handle and the horizontal plane of the riser is adjustable between about 60 degrees and about 30 degrees. The angle between the handle and the horizontal plane of the riser can be adjustable anywhere between about 160 degrees and about 0 degrees, including the embodiments listed above, and as one of ordinary skill in the art would recognize, any range between about 160 degrees and 0 degrees. The handle pivoting towards the horizontal plane of the riser is advantageous over the prior art in that it provides for more compact bow. Unlike the prior art, the variety of angles that can be formed between the handle and the horizontal plane of the riser provide for a variety of positions which effectively eliminate torqueing. This provides for a user to shoot from more angles and positions than the prior art while eliminating the adverse effects of torqueing.

The more compact bow of the present invention compared to the prior art is also advantageous with respect to storage, carrying the bow around (such as on a backpack), avoiding obstacles when shooting the bow, etc. In a preferred embodiment, the handle is adjustable forward and backward along the riser. By adjusting the handle position, the archer correspondingly adjusts the functional draw length of the bow. The handle adjustment preferably is in increments of ⅛", which is accomplished by having riser holes spaced ¼" apart and a handle yoke with a pivot hole 1/16" off-center, thereby allowing the handle yoke to be rotated 180 degrees to provide 1/16" extension in front of or behind each riser hole. The elegance of this design feature is that the functional bow remains undisturbed while the handle is moved to change the draw length. Adjusting the handle position requires little effort, which this provides for multiple users to use the same bow. Preferably, the draw length can also be adjusted without tools. Changing the effective draw length does not require any adjustment of the arrow, arrow rest, sights, limbs, cables, cams, cam modules or bowstring. In one embodiment, nothing in the bow must be disassembled to change the draw length. Advantageously, the draw length can be adjusted in real time or in near real time. In one embodiment of the present invention, the draw length can be adjusted from about 25.5 inches to about 29.125 inches. It is apparent to those with ordinary skill in the art that the present invention lends itself to embodiments designed for any practical range of draw lengths, including but not limited to, from about 22 inches to about 27 inches, from about 23 inches to about 28 inches, from about 24 inches to about 29 inches, from about 25 inches to about 30 inches, and any combination thereof.

In an alternative embodiment, the riser holes are spaced about ⅓" apart. In another alternative embodiment, the riser holes are spaced about ⅕" apart. In yet another alternative embodiment, the riser holes are spaced between about 0.508 and about 0.847 cm. Further, an alternative embodiment includes open square spaces to allow for handle connection. Further still, an alternative embodiment includes handle connections that lock in place. Further still, separate alternative embodiments contain a pivot hole on the handle yoke that is 1/14", 1/15", and 1/17" off-center. Alternative embodiments use other mechanical methods for adjusting the location of the pivoting handle, such as guide rails and clamps and cantilevered struts with setscrews. It is plain to those skilled in the art that other mechanisms for adjusting the location of the pivoting handle are envisioned and within the scope of the present invention, but have been deleted for sake of conciseness.

In an alternative embodiment, the handle pivots with respect to an axis perpendicular to the horizontal structural riser. In one embodiment, the handle mounts to the device via a bi-axial gimbal, thus providing rotation of the compound bow in the horizontal and vertical planes. In yet another embodiment, the handle of the device pivotally attaches to the riser via a tri-axial gimbal or a mechanical ball-and-socket joint, thus providing multi-axial rotation of the bow with respect to the handle. The handle mount may be U-shaped or any other shape that allows the handle to be positioned out of the arrow's path, thus affording a clear avenue for shooting.

Specifications, such as draw weight, are independently adjusted from draw length. Draw weight is preferably altered to match an archer's strength. To adjust the functional draw weight, the screws affixing the limbs to the riser are loosened or tightened. Compound bows in the prior art typically have draw weight ranges of about 10 pounds. For example, a 75 pound draw weight could be adjusted down to 65 pound. The compound bow of the present invention preferably has a highly adjustable draw weight range between about 5 and about 40 pounds. More preferably, the compound bow of the present invention has a draw weight range of about 40 pounds. This is a design feature of the riser and limb pockets. An example embodiment has a draw weight that can be adjusted continuously between about 25 and about 65 pounds, thereby allowing a large adult and a small child to use the same bow. In other embodiments, the draw weight can be adjusted to be as low as 10 pounds, 15 pounds, 20 pounds, 25 pounds, 30 pounds, 35 pounds, or 40 pounds, and as high as 45 pounds, 50 pounds, 55 pounds, 60 pounds, 70 pounds, 75 pounds or 80 pounds. The compound bow of the present invention is, therefore, completely adjustable. Further, the design is such that these adjustments do not require the aid of a bow press.

Notably, the compound bow of the present invention has a bow speed of about 300 feet per second using an approximately 55 pound draw weight and an arrow weight of about 268 grains.

In a preferred embodiment, the limbs are adjustably attached to the riser via adjustment screws in the limb pockets. These adjustment screws are loosened and tightened to change the preloaded of the limbs and ultimately the draw weight, according to the user's desire. In one embodiment, the adjustment screws span about 0.1-3 inches long. Preferably, the adjustment screws span about 0.1-1.75 inches long. Alternatively, the adjustment screws are between about 0.5 inches and about 1.5 inches long. In another embodiment, the adjustment screws are between about 1 inch and 1.5 inches long. In yet another embodiment, the adjustment screws are between about 1.5 inches and 2.5 inches long. In one embodiment, the adjustment screw spans about 1.5 inches. When the screws are loosened, the bowstring is slackened and cam, cable and bowstring adjustments can be made as tuning and timing work is needed. In this way, adjustments can be made without a bow press. In the prior art, limbs may be adjustable, but if the screws are loosened to the point where the screws come out, the bow will come apart because of the flex in the limbs. However, the screws of the present invention are preferably long enough so that the limb pocket screws can be unscrewed completely or removed. This is advantageous as it allows the bow to be taken apart without specialized equipment, and also reduces or eliminates the risk of injury from taking apart the bow. Affixed to the ends of both sets of parallel split limbs, opposite the ends secured by the limb pockets, are radial cam pulleys; there is one cam pulley for each set of split limbs. Connecting the two cams are a bowstring and four cables. On the cables are cable spreaders. In a preferred embodiment of the present invention, the cam pulleys operate using a twin cam (also called two cam or dual cam) system. Alternatively, the cam arrangement can be customized to suit the archer's or manufacturer's preferences. By way of example and not limitation, other cam types that can be used include hybrid, single, or binary cams.

In a preferred embodiment, four cables are used along with cable spreaders. The cable spreaders serve two purposes: to feed the cables into the cam module channels in the plane of the module channels, and spread out the cables such that the arrow can pass between them without interference. With single or two cable systems, the cable often needs to be held away from the arrow's path by a system of sliders or pulleys. This is done off center, meaning that the cables, which function to flex the limbs, are not symmetrically flexing the limbs, causing them to perform differently and fatigue. The unbalanced flexing is often masked by adjusting the aim to compensate for poor arrow flight, which ultimately results in less efficient, less smooth, less accurate designs. Therefore, the four cable design, in conjunction with the cable spreaders, allows both sets of limbs to flex the same and prevent limb leaning. An alternative embodiment does not use cable spreaders with the four cable system. Yet another embodiment uses cable spreaders that do not bring the cables in the plane of the cam module channels. Alternative embodiments use cable systems that correspond to alternative cam systems and may or may not use cable spreaders. Those skilled in the art will recognize the advantages and disadvantages of applying various cam and cable systems to this bow and understand that the scope of this invention is not limited to any specific cable or cam system, or the use of cable spreaders.

Solid limb advocates propose that solid limbs offer better torsional stiffness and are more accurate than split limbs. Split limb advocates propose that split limbs are more durable and produced less hand-shock than solid limbs. Limb materials, technologies, and composites continue to improve, thereby reducing the strength of either advocate's proposition. However, the preferred embodiment of the present invention uses a split limb style, so that reaction forces from the limbs are more directly converted to in-plane stresses in the riser plates. In an alternative embodiment, the limbs are solid, albeit containing a slit for cam pulley insertion, attachment, and rotation. Alternative embodiments include solid limbs or split limbs, the centers of which do not align with the riser plates. In these embodiments, it is recommended, but not required, that the limbs are affixed to the riser such that the reaction forces act through the center of the riser plates. In yet another embodiment, the compound bow includes one main riser structure, and the limbs are affixed out of the plane of the riser. In yet another embodiment, the compound bow includes one main riser structure and the limbs are affixed in the plane of the riser.

In a preferred embodiment, the length of the compound bow from axle to axle is between about 17 to 18 inches. Alternatively, the axle-to-axle length can be anywhere from about 17 inches to 20 inches. In another embodiment, the axle-to-axle length is between about 16 inches and 23 inches, or longer if desired. However, most preferably, the axle-to-axle length is about 17 inches. This preferred axle-to-axle length is about half that of most compound bows of prior art. A small bow is advantageous because it is easily maneuverable and interference from tree limbs, shooting rails, tree trunks and ground blinds is minimized when hunting. The small size is afforded by the geometry and design of the riser, cable, and cam systems. In one embodiment, the geometry of the riser is generally triangular in shape. In other embodiments, the geometry of the riser is rectangular, pentagonal, hexagonal, heptagonal, or octagonal. Additional embodiments do not have a closed shape. It is obvious to those skilled in the art that the general outline or shape of the riser is an open design variable that is not limited by the scope of this invention.

In a preferred embodiment, due to its compact size and efficient management of structural stresses, the weight of the present invention is between about 2.5 to 3.0 pounds. Alternatively, the weight is between about 2.0 to 2.5 pounds. In yet another alternative, the weight is between about 3.0 and 4.0 pounds. In yet another embodiment, the weight is between 3.0 pounds and 5.0 pounds. In another embodiment, the bow is approximately 3 pounds. In another embodiment, the bow is approximately 3.5 pounds. In a preferred embodiment, the bow is about 2.8 pounds.

Unlike a traditional, vertically-oriented compound bow, the nontraditional, horizontally-oriented compound bow of the present invention is much less likely to interfere with a ground blind, tree stand, or thick brush while being used to hunt. Although in the horizontal plane, this compound bow requires the same shooting mechanics of the traditional compound bow, allowing an archer to easily transfer his/her skills. Further, the horizontal structure provides a great alternative for disabled archers, specifically those who are wheelchair-bound, where a vertical bow would interfere.

FIG. 1 illustrates a preferred embodiment of the device of the present invention. The riser 10 is the central body of the device. Pivot bars 11 are mounted to the riser by mounting brackets FT A handle 14 is attached to the riser 10 via a yoke 12, the handle being adjustably movable from the front to the back of the pivot bars 11 using pivot attachment holes 13. An arm brace 16 is attached to the handle. Affixed to the riser 10 are split limbs 20 via limb pockets 22. The split limbs 20 are adjustable by adjustable limb screws 24. At the opposite end of the split limbs 20 are cam pulleys 26. The cam pulleys 26 at each end of each split limb 20 are connected by bowstring 30. Centrally located in the bowstring 30 is a nock point 34 and a set of cable spreaders 32, which provide a window for the arrow 40 to shoot through. Supporting the arrow 40 and attached to the riser 10 is an arrow rest 42. A sight 44 is mounted to the riser via an accessory mount 43. Notably, unused pivot adjustment holes 13 can also serve to mount accessories. The vertical bar connecting the riser is in the vertical plane, although in the present invention, with a bend inward, which is preferable. Alternatively, the bar can be completely vertical, which would allow for more pivot adjustment holes 13 and a greater change in draw length, since draw length is a product of handle 14 adjustment (i.e. draw length can be affected without modifying bowstring, cam pulleys, or limbs).

Figure 2:
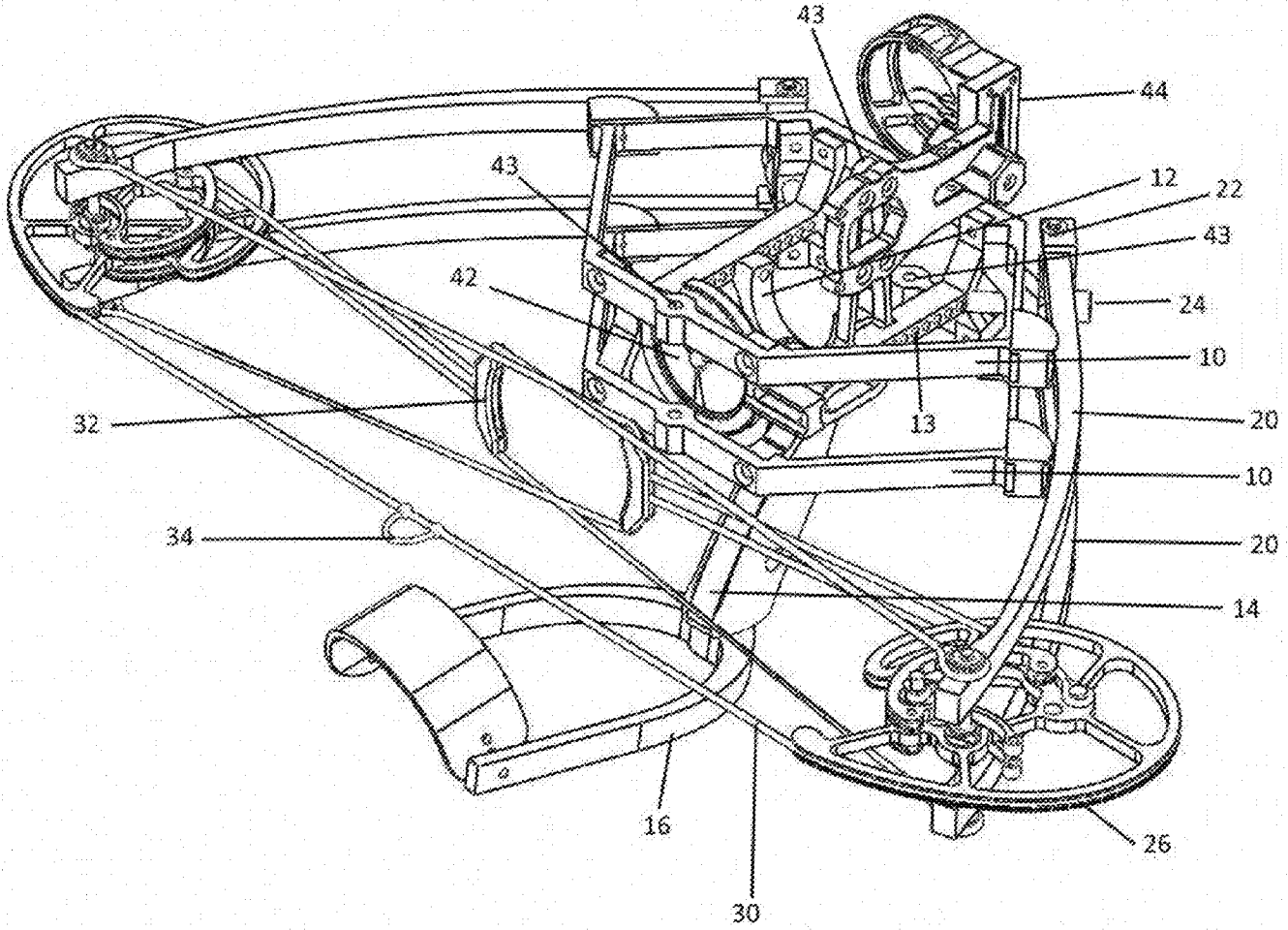
FIG. 2 illustrates a full, top-right perspective image of the present invention.

FIG. 2 illustrates a full, top-right perspective image of the present invention. The riser 10 is the central body of the device. A handle 14 is attached to the riser 10 via a handle yoke 12, the handle being adjustably movable from the front to the back of the riser 10 using pivot attachment holes 13. The yoke 12 also enables the handle to pivot using the pivot attachment holes 13. An arm brace 16 is attached to the handle. Affixed to the riser 10 are split limbs 20 via limb pockets 22. The split limbs 20 are adjustable by adjustable limb screws 24. At the opposite end of the split limbs 20 are cam pulleys 26. The cam pulleys 26 at each end of each split limb 20 are connected by bowstring 30. Centrally located on the bowstring 30 is a nock point 34. A set of cable spreaders 32 provide a window for the arrow to shoot through. Supporting an arrow within the riser 10 is an arrow rest 42. A sight 44 is mounted to the riser 10 via an accessory mount 43. The sights, arrow rest and any other accessory have several optional mounting points to accommodate various components and user preferences.

Figure 3:
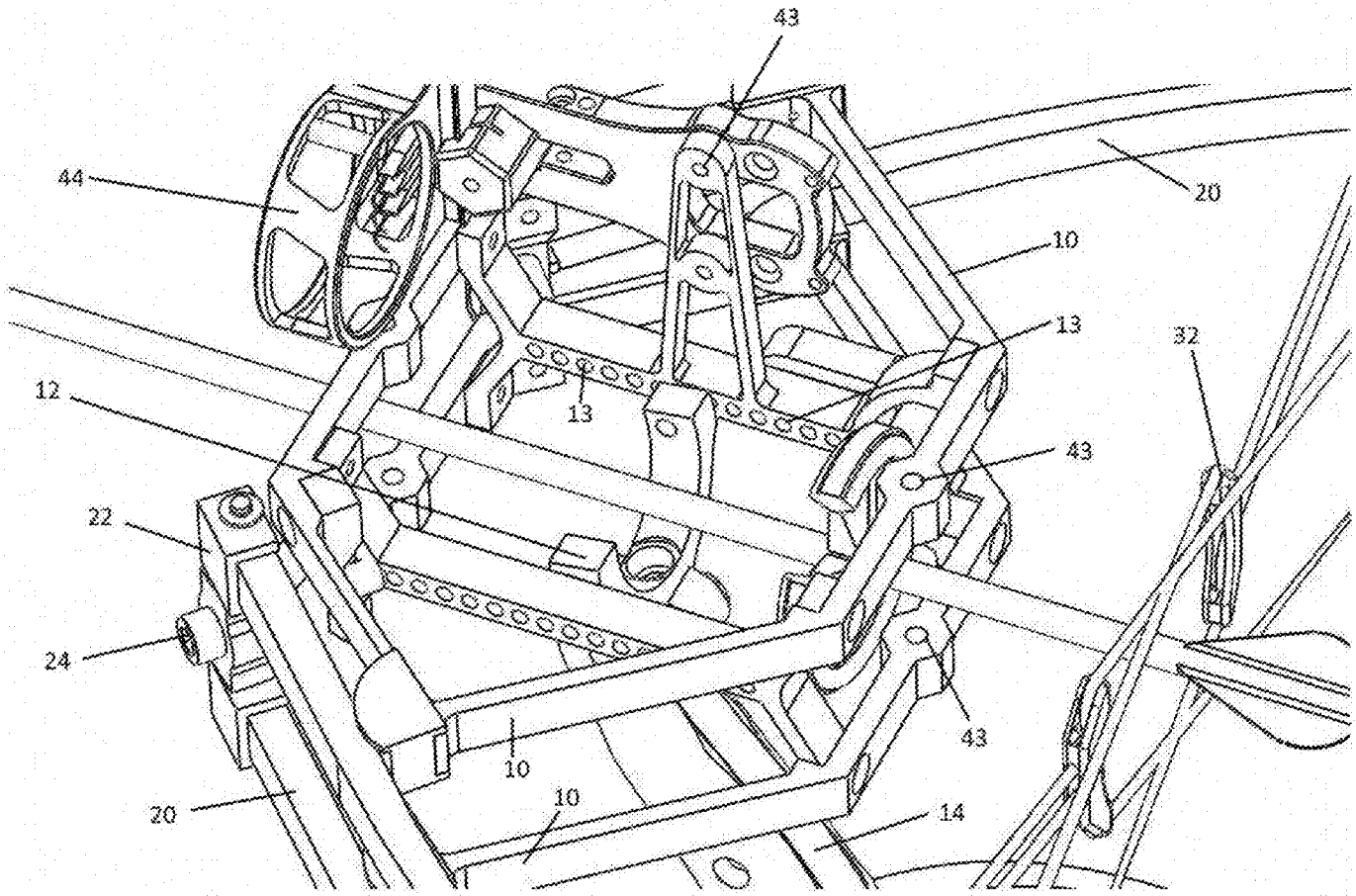
FIG. 3 illustrates a close up, top-left perspective view diagram of the riser, sight, and related components of the present invention.

FIG. 3 illustrates a close up, top-left perspective view diagram of the riser 10, sight 44, and related components of the present invention. Attached to the riser 10 is the handle via a yoke 12, the handle being adjustably movable from the front to the back of the riser 10 using pivot attachment holes 13. The split limbs 20 are adjustable by adjustable limb screws 24. Affixed to the riser 10 are split limbs 20 via limb pockets 22. A sight 44 is mounted to the riser 10. The sight is movable from the front to the back of the riser 10. The handle 14 is also depicted, as well as the cable spreaders 32 and accessory mounts 43.

Figure 4:
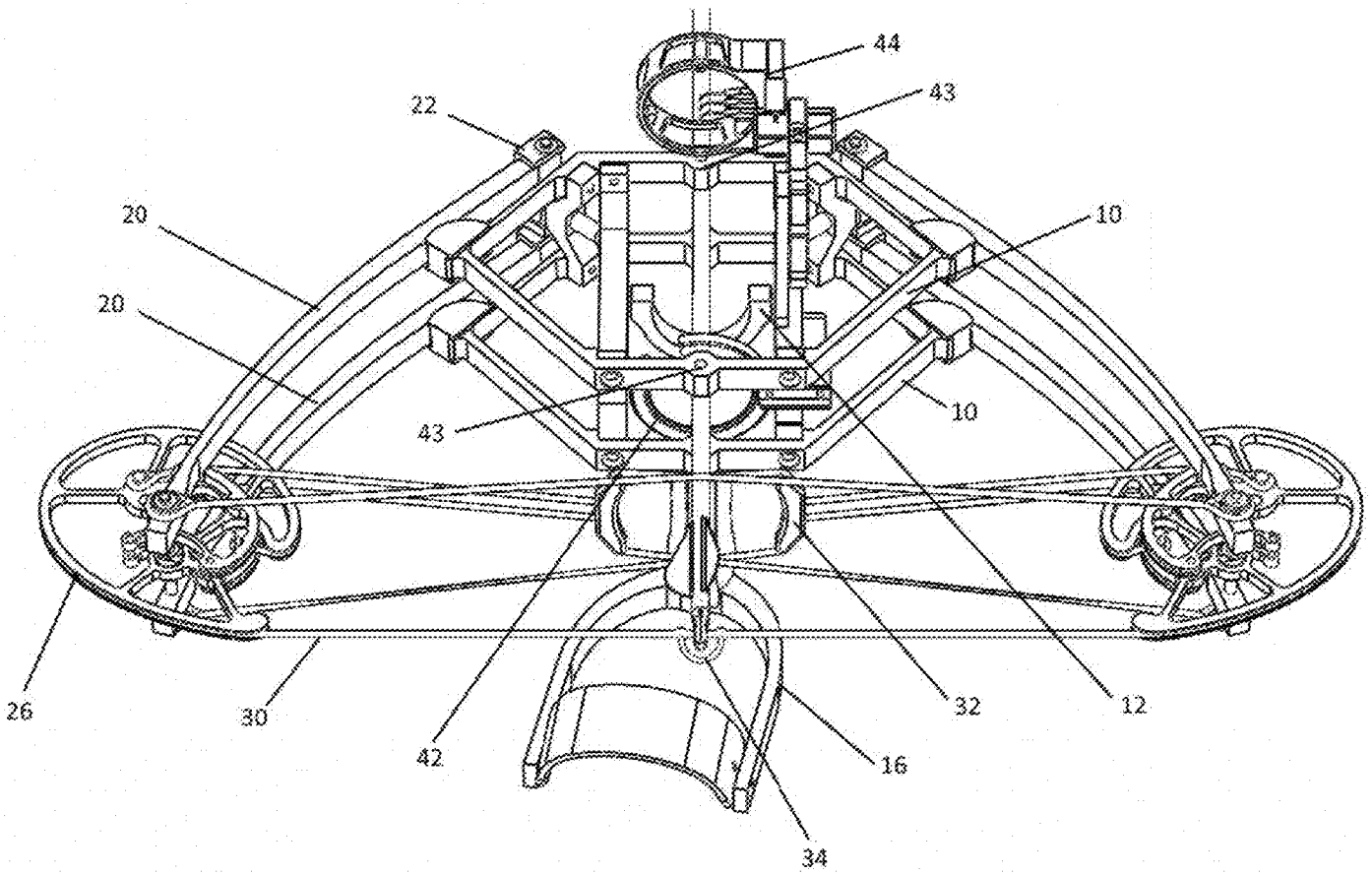
FIG. 4 illustrates a top, rear perspective view image of the present invention.

FIG. 4 illustrates a top-rear perspective view image of the present invention. The riser 10, yoke 12, arm brace 16, split limbs 20, cam pulleys 26, bowstring 30, cable spreaders 32, nock point 34, arrow rest 42, accessory mounts 43, and sight 44 are depicted in this view.

Figure 5:
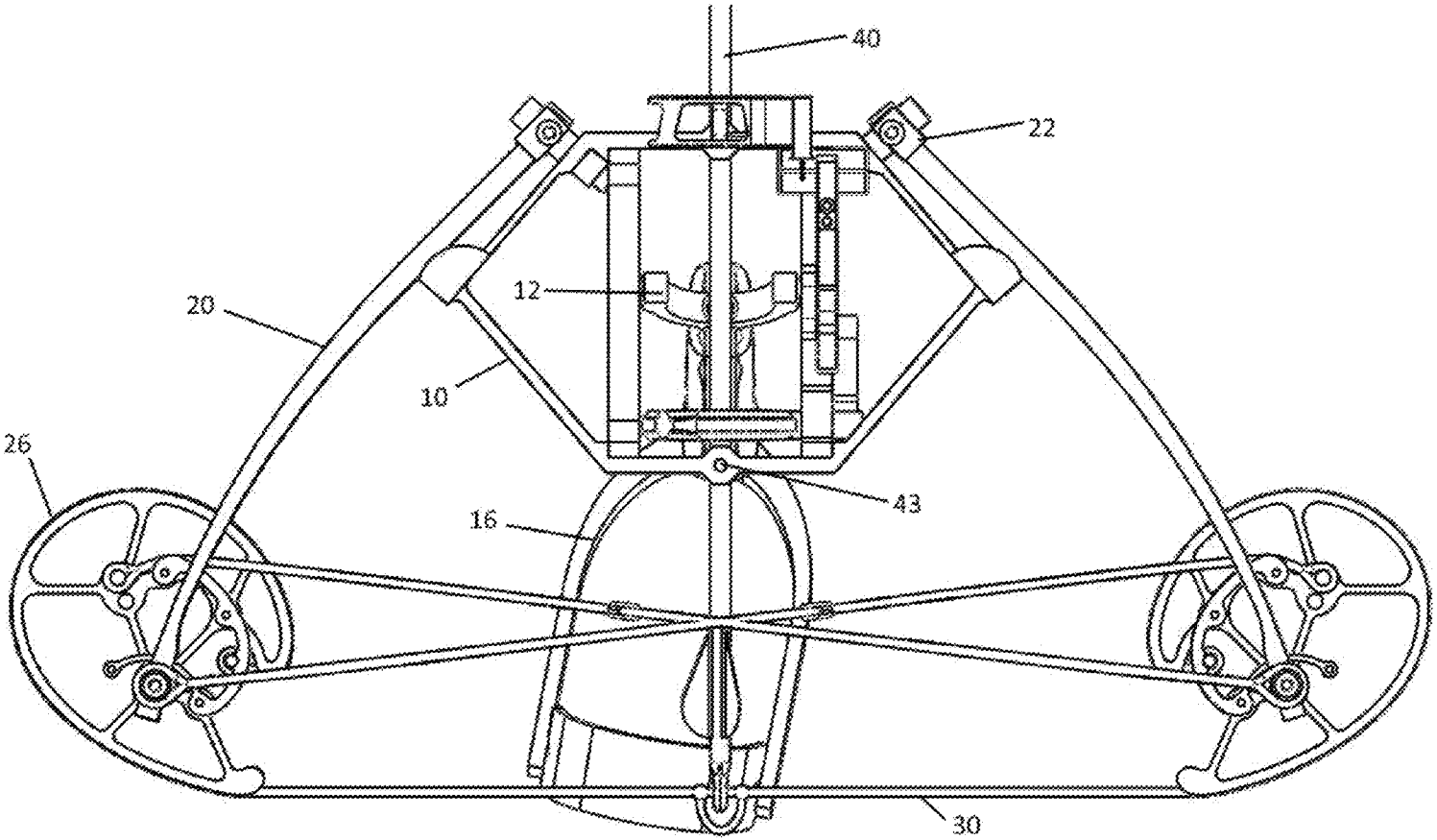
FIG. 5 illustrates a top perspective view image of the present invention.

FIG. 5 illustrates a top perspective view of the basic structure including an arm brace 16, riser 10, and limb pockets 22. The yoke 12 area is displayed next to the horizontal, linear members. Accessory mounts 43 are displayed at the front edge and back edge of the riser 10.

Figure 6:
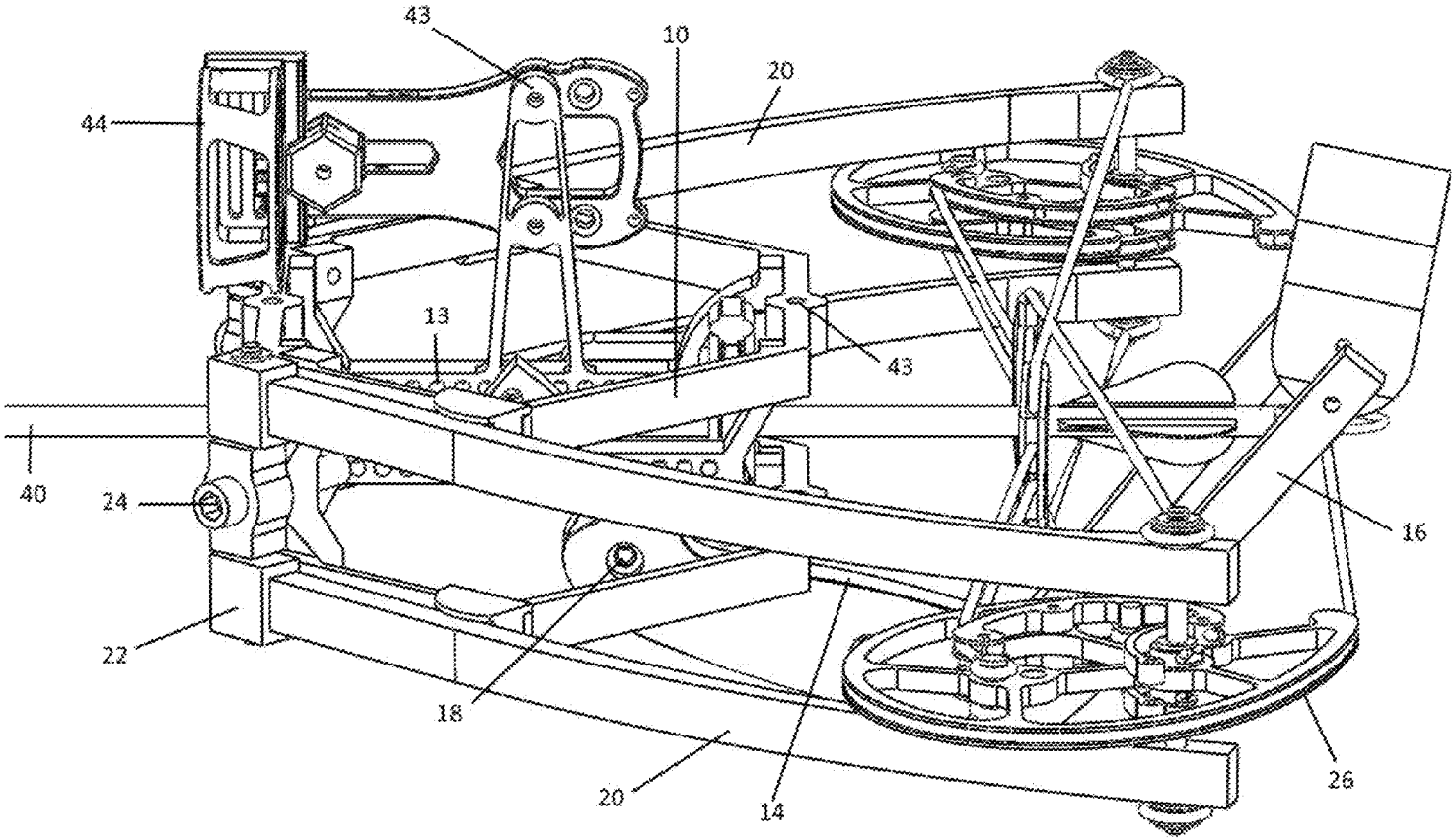
FIG. 6 illustrates a top-left, side perspective view image of the present invention.

FIG. 6 illustrates a side perspective view with the handle 14 fully pivoted toward the riser 10. The limb pockets 22, split limbs 20, and adjustable limb screw 24 confer complete adjustability and customizability of effective draw weight. The cam pulley 26 system is displayed at the opposite end from the limb pocket 22.

Figure 7:
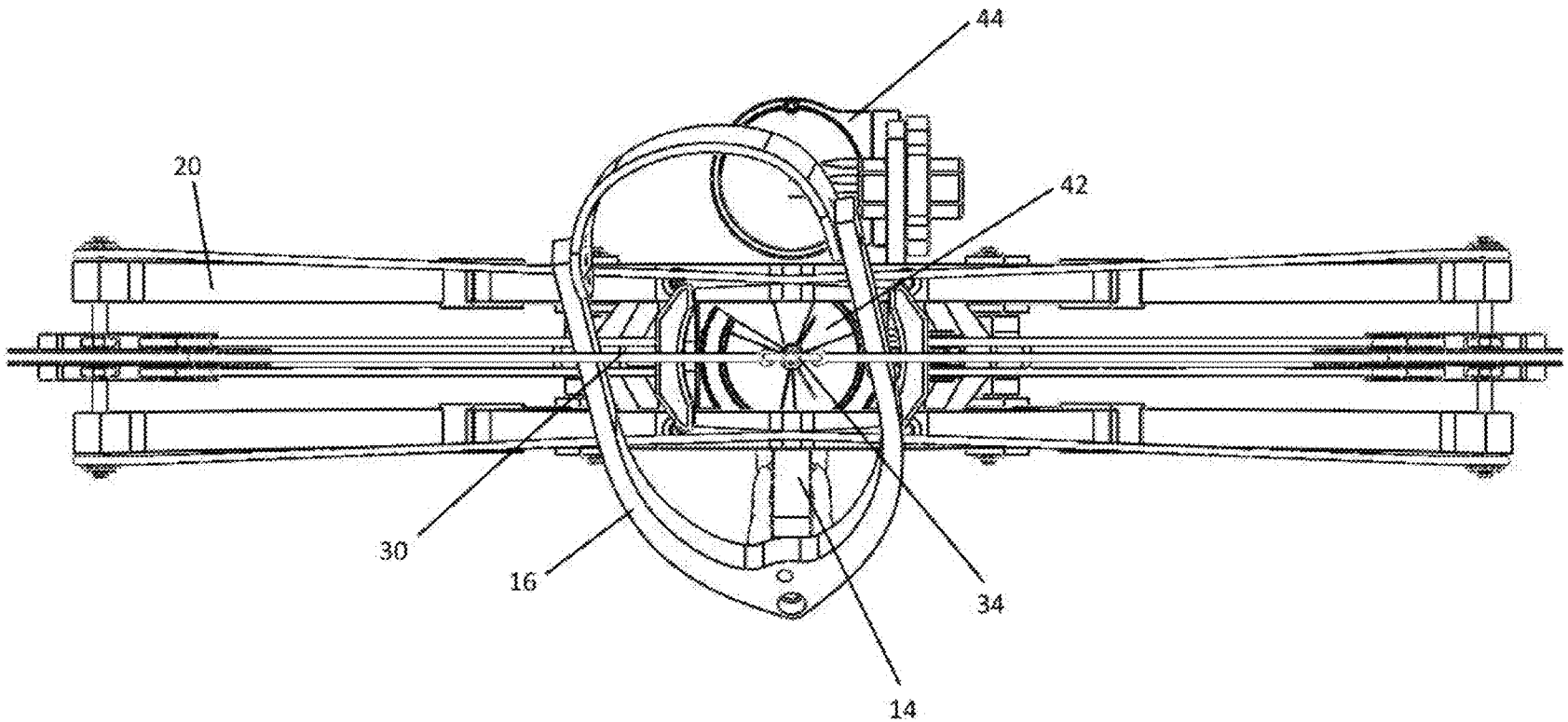
FIG. 7 illustrates a rear perspective view image of the present invention.

FIG. 7 illustrates a rear perspective view of the present invention. The arrow rest 42, clearly visible in this view, is directly behind the nock point 34. The sight 44, handle 14, bowstring 30, arm brace 16, split limbs 20, and other components are also displayed.

Figure 8:
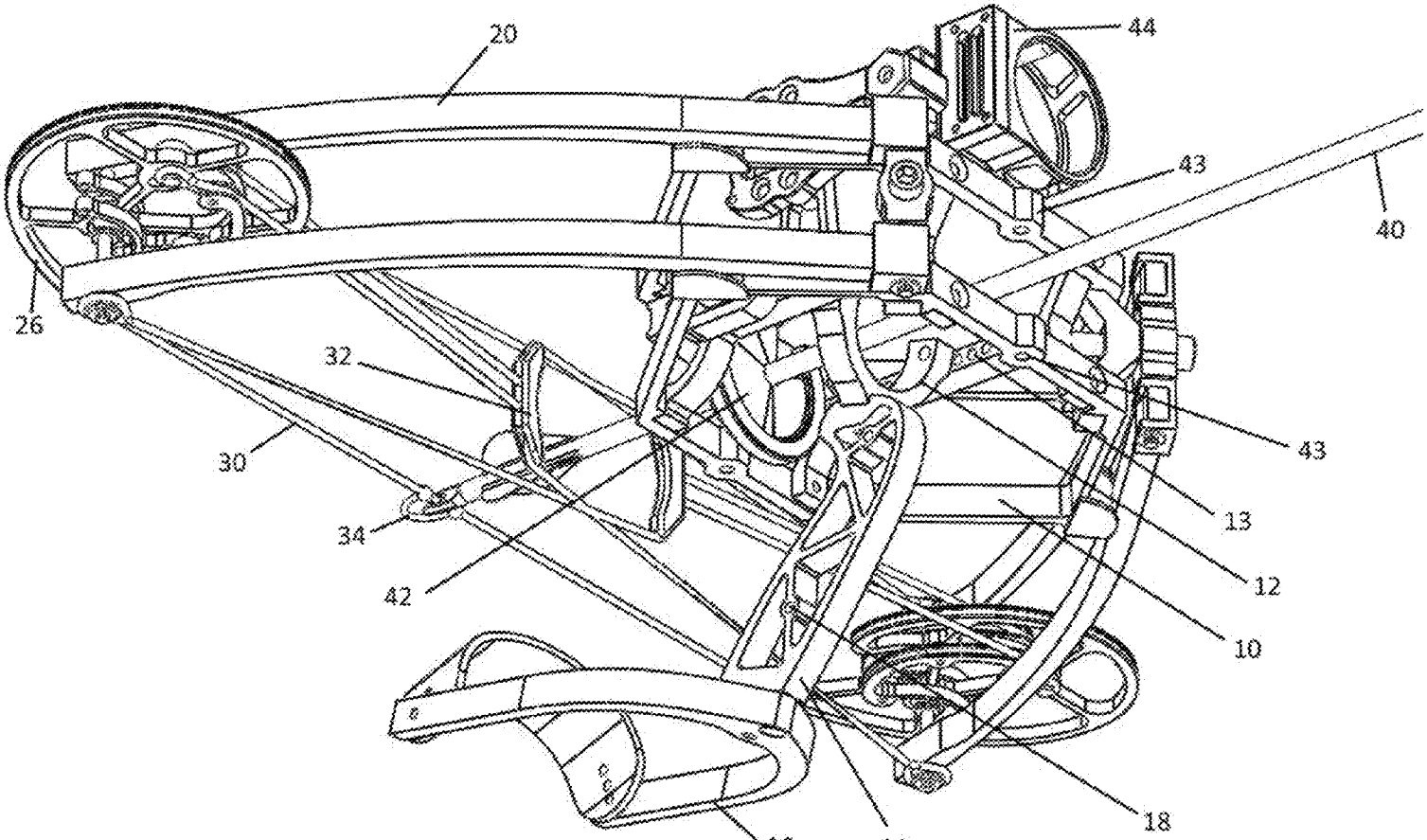
FIG. 8 illustrates a bottom-right perspective view image of the present invention.

FIG. 8 illustrates a bottom-right perspective view image of the present invention. The grip screw threads 18 are clearly visible in this view. The grip screws attach the grip to the handle frame, thus allowing custom grip assembly. An archer may add a custom wood or synthetic grip, or use the custom grip assembly without adding a grip. The riser 10, yoke 12, pivot attachment holes 13, handle 14, arm brace 16, split limbs 20, cam pulleys 26, bowstring 30, cable spreaders 32, nock point 34, arrow 40, arrow rest 42, accessory mounts 43, and sight 44 are depicted in this view.

Figure 9:
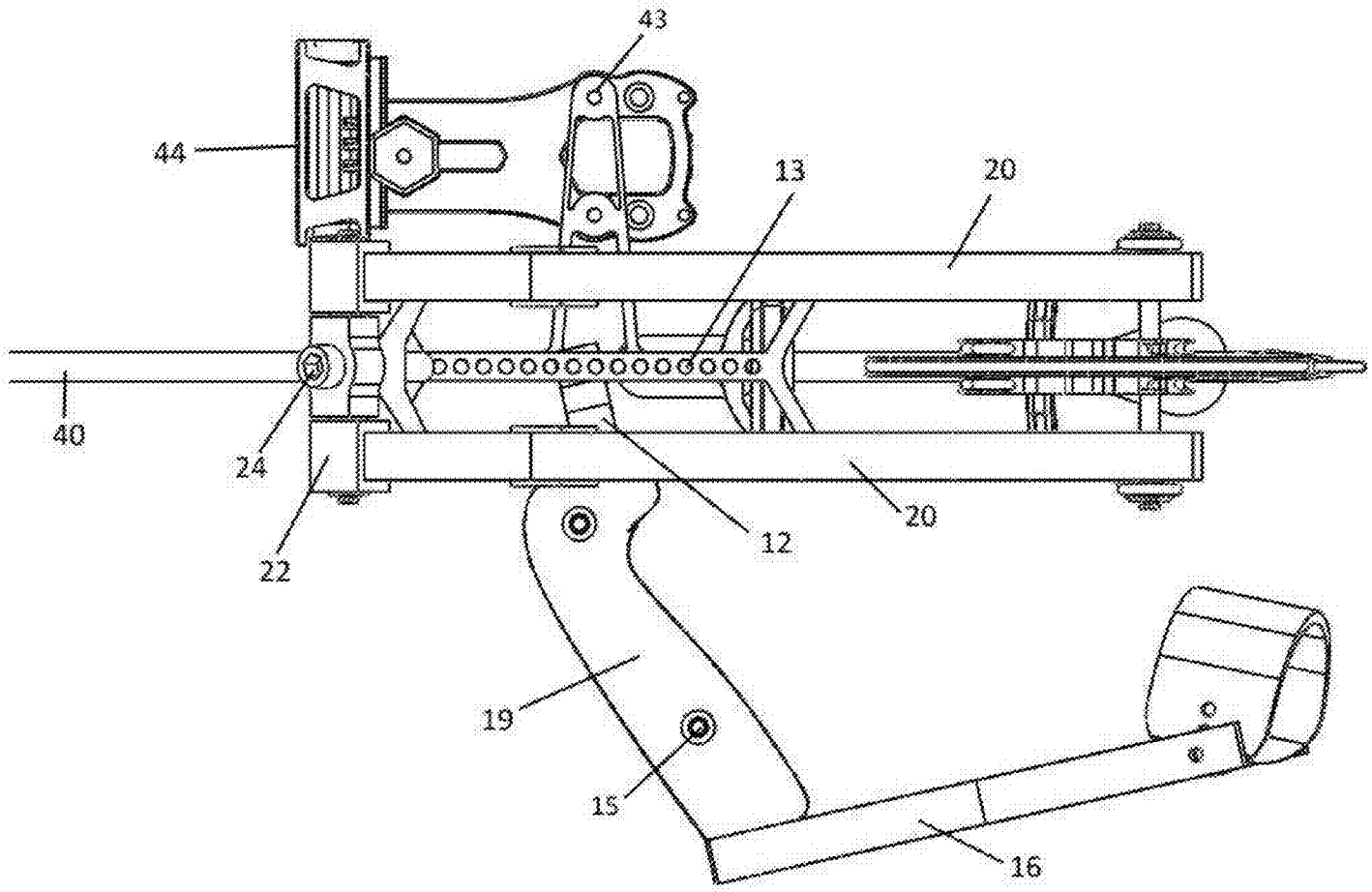
FIG. 9 illustrates a left side perspective view image with the handle extended of the present invention.

FIG. 9 illustrates a left side perspective view of the present invention with a handle grip 19 covering the handle, with the handle grip 19 being held in place by grip screw 15 inserted into the grip screw threads. The yoke 12, pivot adjustment holes 13, arm brace 16, split limbs 20, limb pockets 22, limb adjustment screw 24, arrow 40, and sight 44 are depicted in this view.

Figure 10:
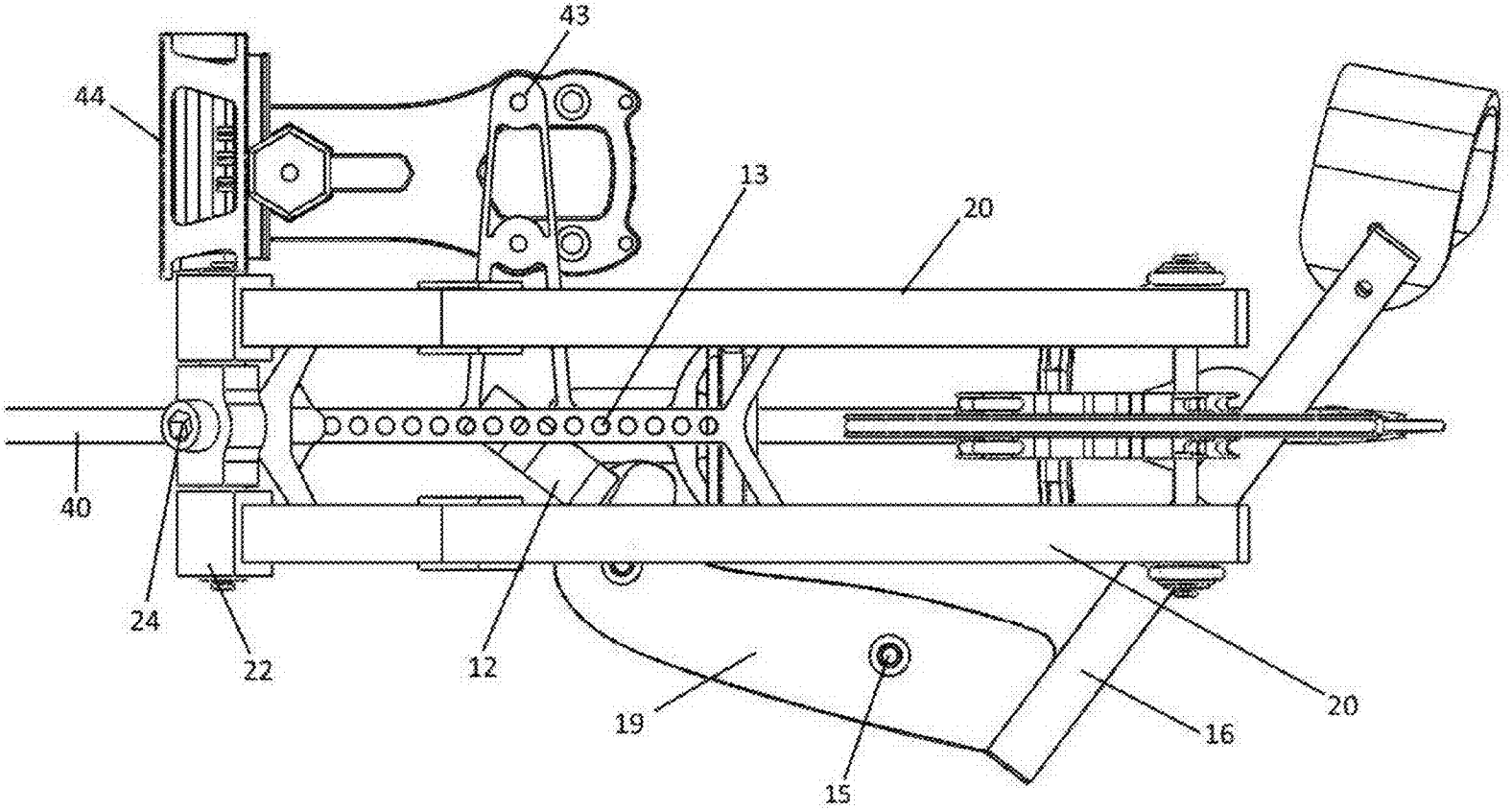
FIG. 10 illustrates a left side perspective view image with the handle collapsed of the present invention.

FIG. 10 illustrates a left side perspective view image with the handle collapsed of the present invention. A handle grip 19 covers the handle, with the handle grip 19 being held in place by grip screw 15 inserted into the grip screw threads. The yoke 12, pivot adjustment holes 13, arm brace 16, split limbs 20, limb pockets 22, limb adjustment screw 24, arrow 40, and sight 44 are depicted in this view.

Figure 11:
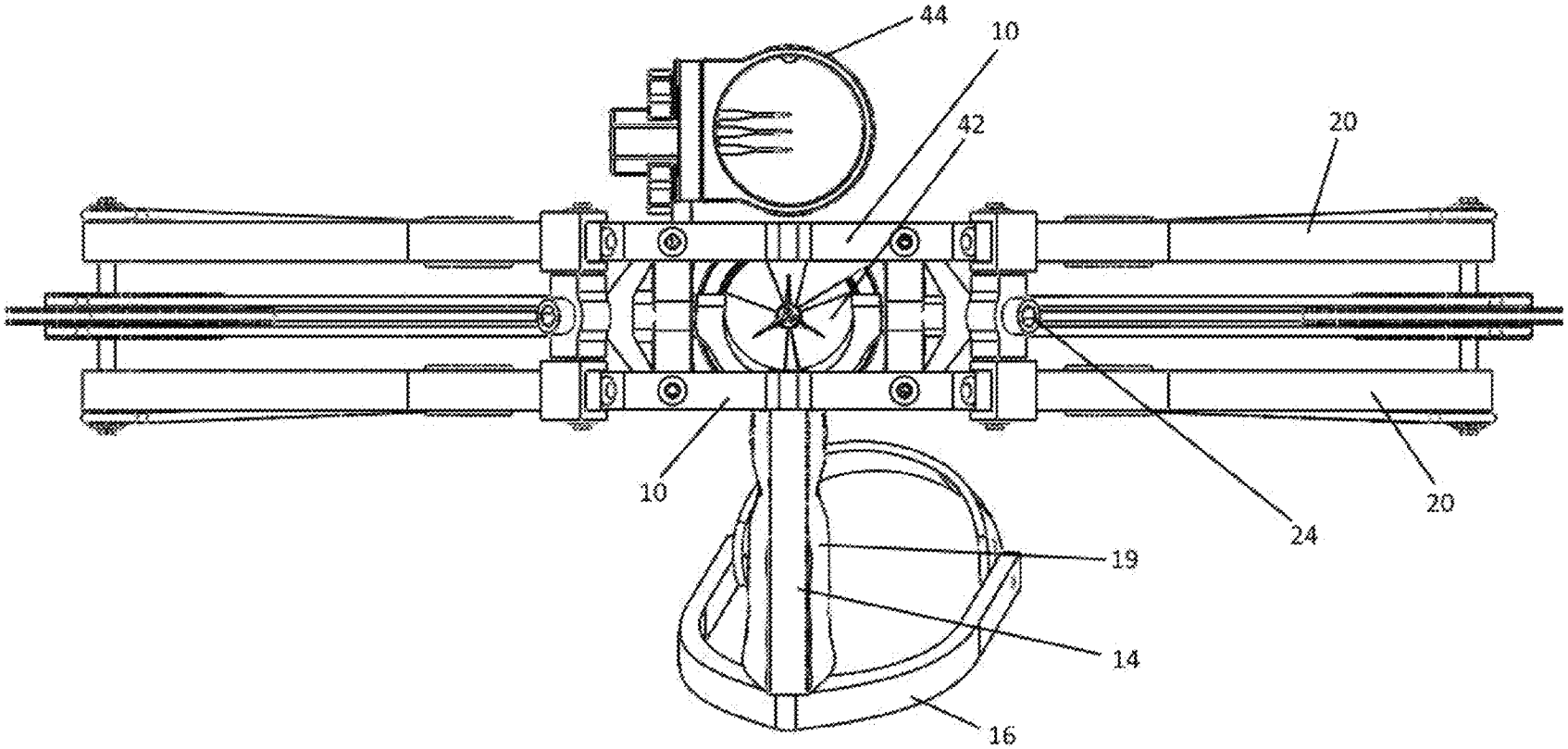
FIG. 11 illustrates a front perspective view image of the present invention.

FIG. 11 illustrates a front perspective view of the present invention. An arrow rest 42 is removably attached to the riser 10. A sight 44 is removably attached to the riser 10. The riser 10, handle 14, arm brace 16, handle grip 19, split limbs 20, and limb adjustment screw 24 are also depicted in this view.

Figure 12:
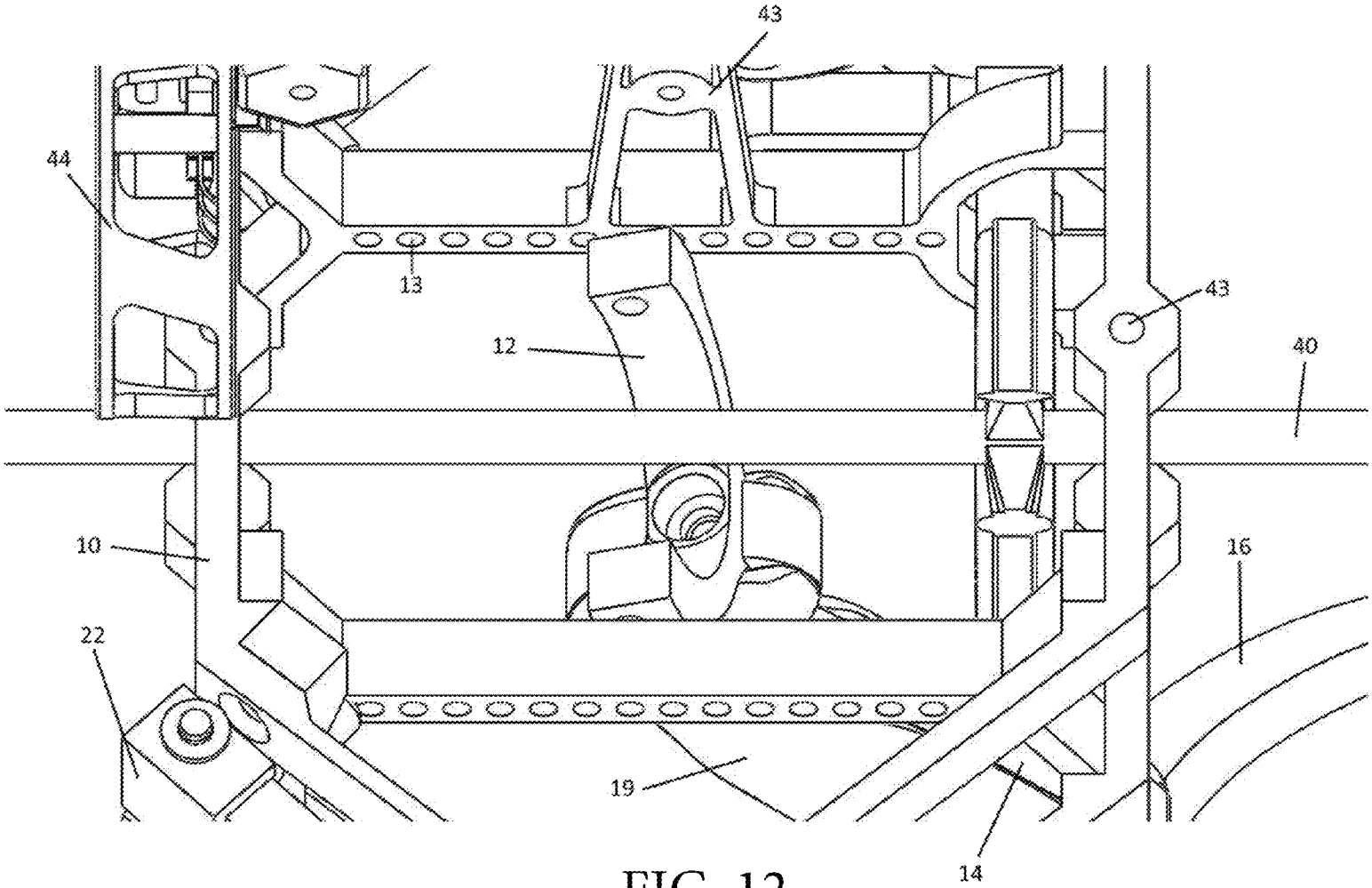
FIG. 12 illustrates a top-left perspective view image of the handle connection of the present invention.

FIG. 12 illustrates a top perspective view focused on the yoke 12, which is inserted into the riser 10, and is adjustably movable from the front to the back of the riser using the pivot adjustment holes 13. The arm brace 16, arrow 40, accessory mount 43, a limb pocket 22, and handle 14 can also be seen in this view.

Figure 13:
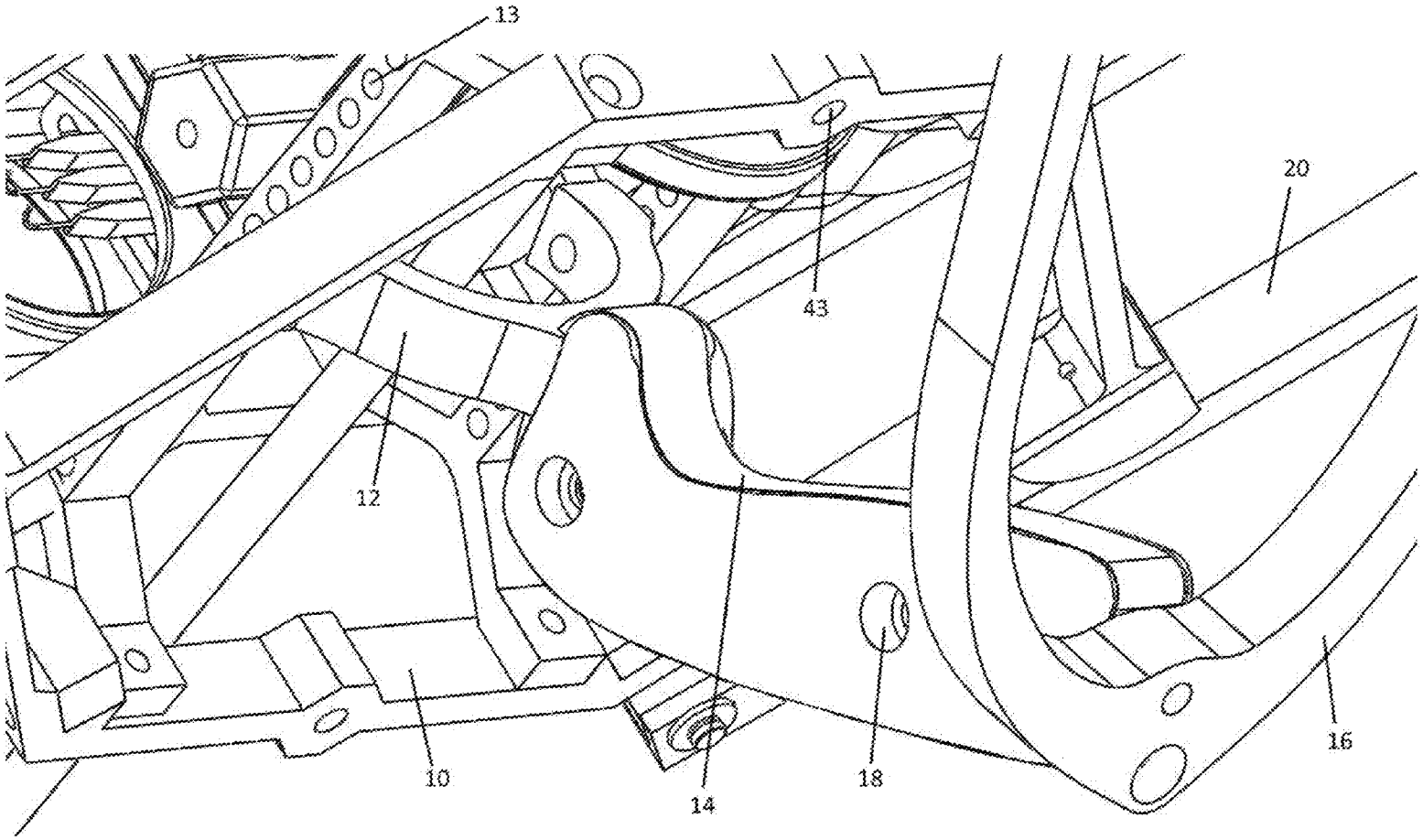
FIG. 13 illustrates a left-bottom-rear perspective view image of the riser and handle connection of the present invention.

FIG. 13 illustrates a left-bottom-rear perspective view image of the riser and handle connection of the present invention. A yoke 12 is inserted into the riser 10, and is adjustably movable from the front to the back of the riser. The arm brace 16, split limbs 20, accessory mount 43, and handle 14 can also be seen in this view.

Figure 14:
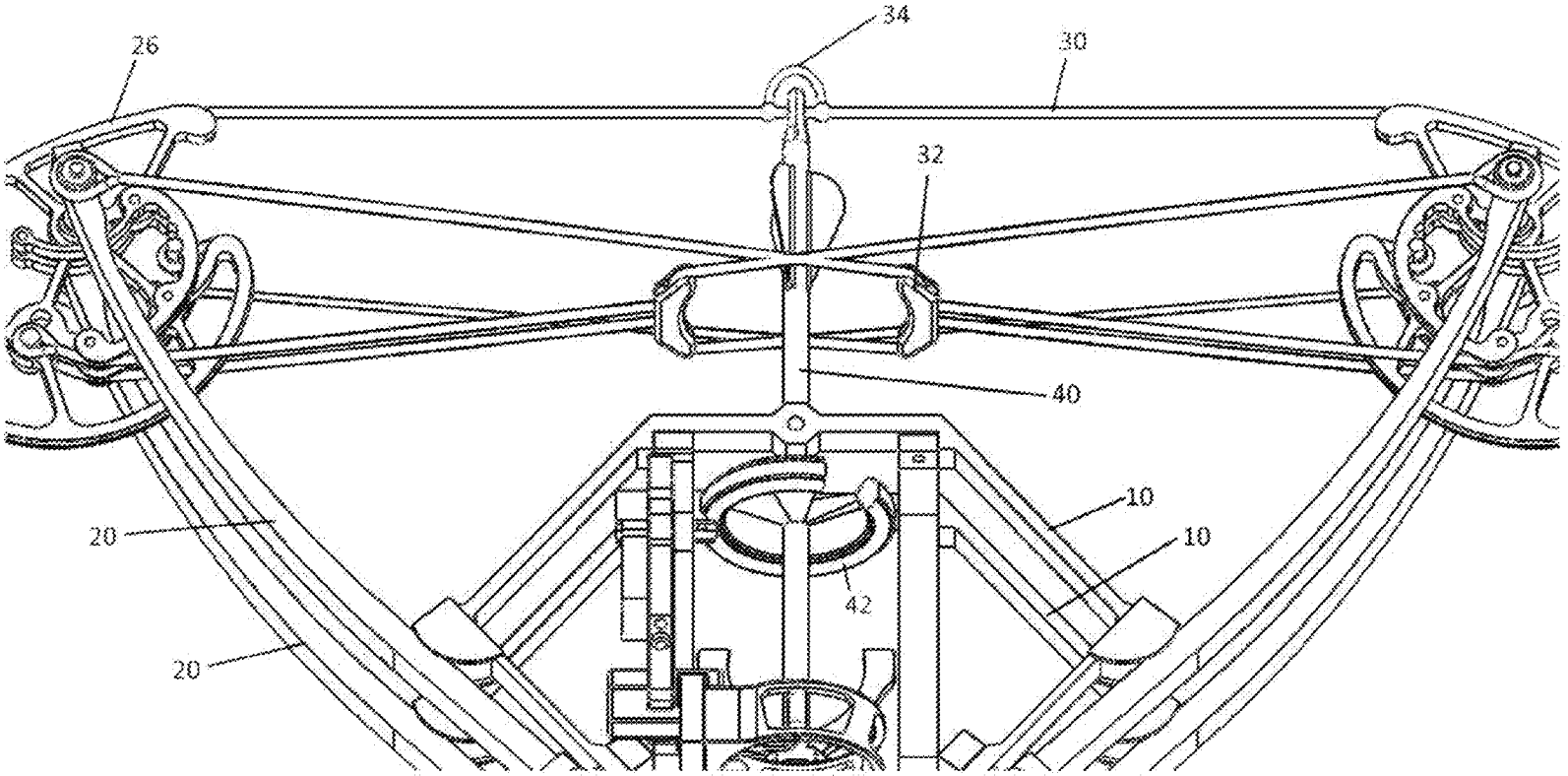
FIG. 14 illustrates a close, top-front perspective view image of the undrawn bowstring and cable spreaders of the present invention.

FIG. 14 illustrates a front, top perspective view of the present invention focused on the window created by the cable spreaders 32. A nock point 34 is in the background. The riser 10, arrow 40, split limbs 20, cam pulleys 26, bowstring 30, and arrow rest 42 are also depicted in this view.

Figure 15:
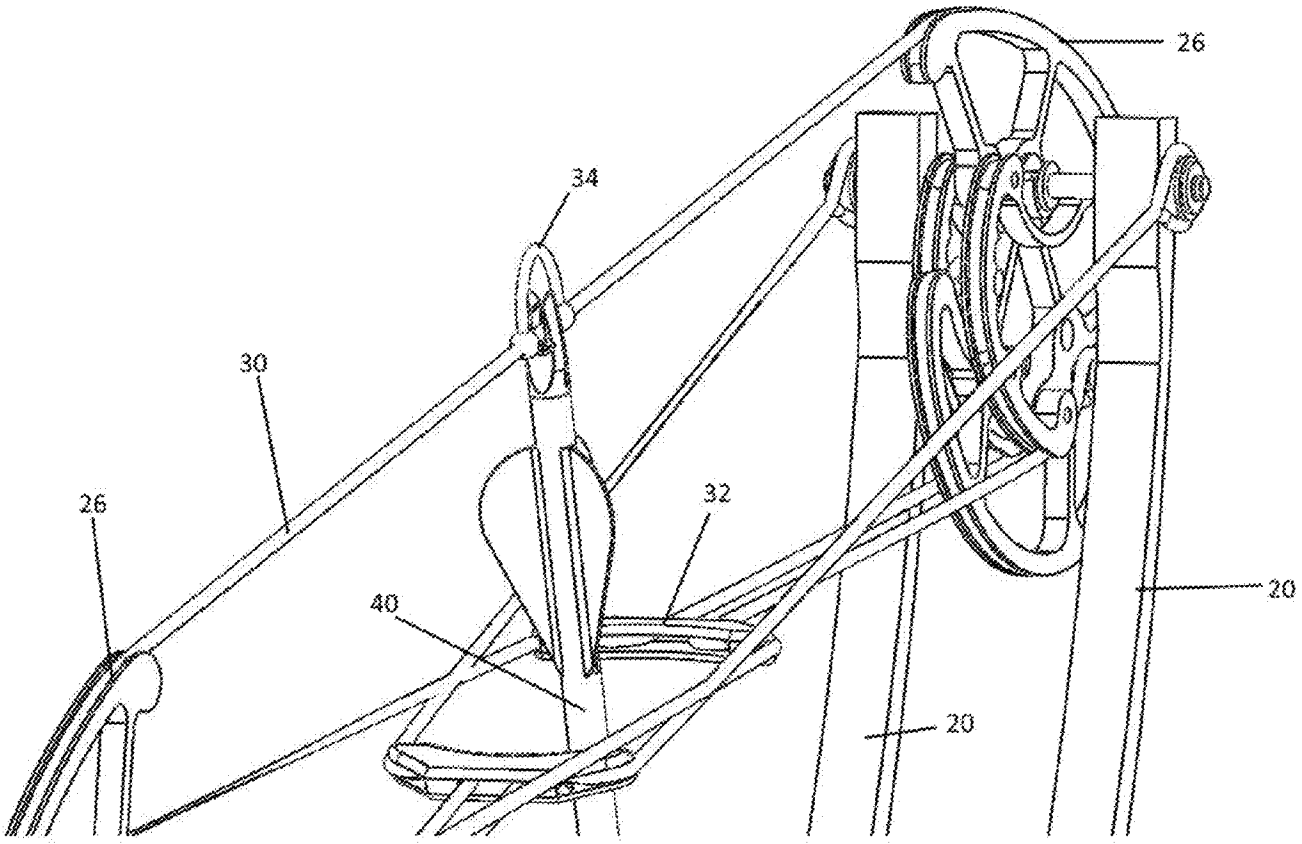
FIG. 15 illustrates a close, right-rear perspective view image of the undrawn bowstring and cable spreaders of the present invention.

FIG. 15 illustrates a close, left-rear perspective view image focused on the window created by the cable spreaders 32. A nock point 34 is above. In the background, is a cam pulley 26. The cable spreaders feed cables into the cam pulleys 26 and spread the cables for the arrow to shoot through. The bowstring 30, arrow 40, and split limbs 20 are also depicted in this view.

Figure 16:
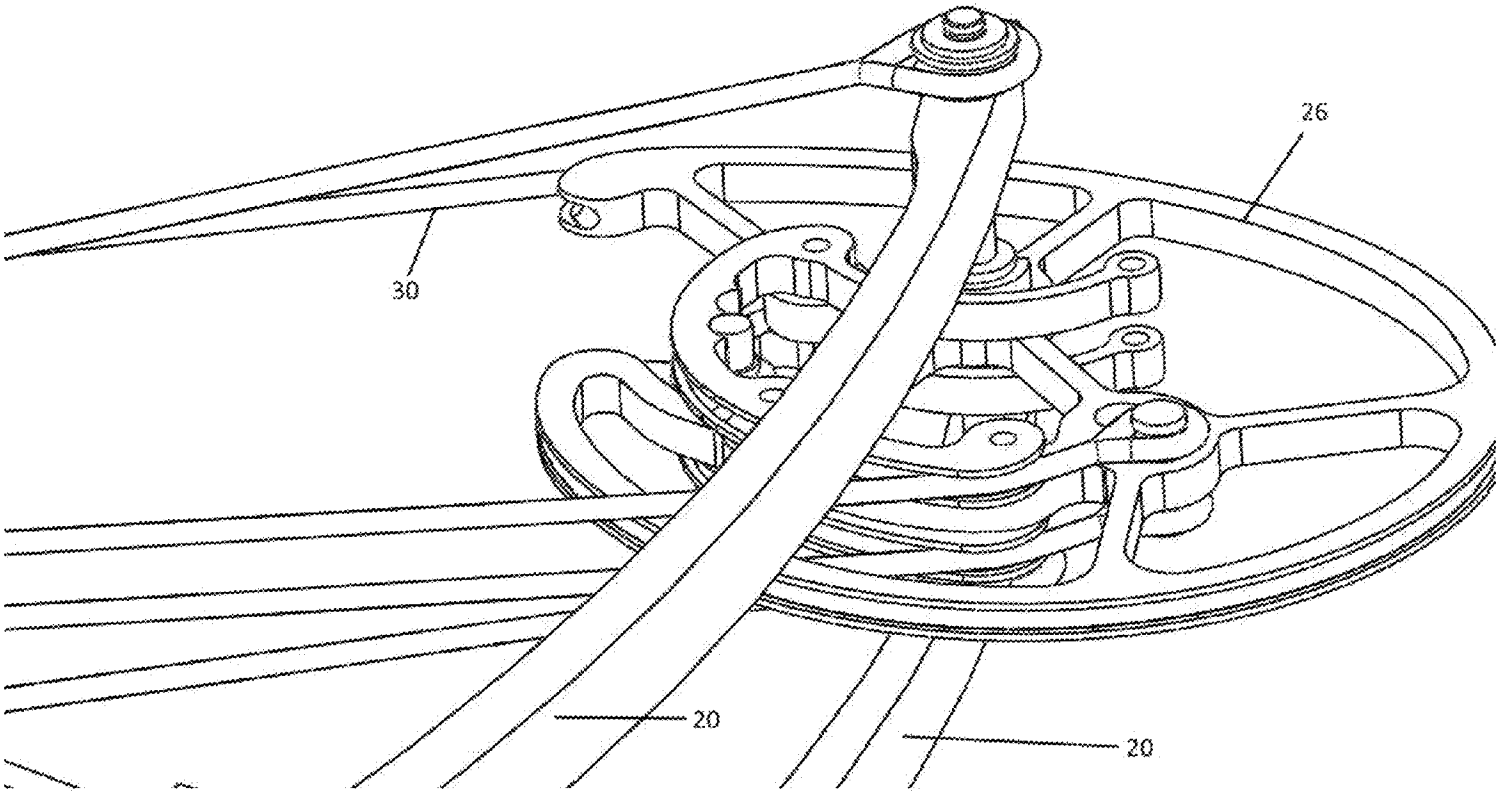
FIG. 16 illustrates a top-front perspective view image of a cam pulley of the present invention.

FIG. 16 illustrates a cam pulley 26 of the present invention. The bowstring 30 is wrapped around the cam pulley 26.

The above-mentioned examples are provided to serve the purpose of clarifying the aspects of the invention, and it will be apparent to one skilled in the art that they do not serve to limit the scope of the invention. By way of example, the handle may pivot in multiple axes. Also by way of example, the limbs may be solid. By nature, this invention is highly adjustable, customizable and adaptable. The above-mention examples are is just some of the many configurations that the mentioned components can take on. All modifications and improvements have been deleted herein for the sake of conciseness and readability but are properly within the scope of the present invention.

What is claimed is:

1. A mechanical projectile device comprising:

a top pair of flexible members and a bottom pair of flexible members, each flexible member having a first end and a second end;

a cam pulley system including cam pulleys and at least one cable;

a bowstring including a nock point;

a handle including a top end a bottom end, wherein the top end of the handle is connected to a yoke and the bottom end of the handle is connected to an arm brace; and a horizontal structural riser including:

a pair of pivot bars including a left pivot bar and a right pivot bar, each pivot bar having a top, a bottom, a front end, a back end, and two sides;

a pair of front mounting brackets including a left front mounting bracket and a right front mounting bracket, wherein the front end of the left pivot bar is attached to the left front mounting bracket and the front end of the right pivot bar is attached to the right front mounting bracket;

a pair of back mounting brackets including a left back mounting bracket and a right back mounting bracket, wherein the back end of the left pivot bar is attached to the left mounting bracket and the back end of the right pivot bar is attached to the right mounting bracket;

a top hexagonal riser plate having an inside, an outside, a front half, a back half, a top, and a bottom;

a bottom hexagonal riser plate having an inside, an outside, a front half, a back half, a top, and a bottom, wherein the bottom hexagonal riser plate is parallel to the top hexagonal riser plate and the top of the bottom hexagonal riser plate faces the bottom of the top hexagonal riser plate;

wherein the pair of front mounting brackets are perpendicularly and symmetrically affixed to the front half of the top hexagonal riser plate on the inside of the top hexagonal riser plate and the pair of front mounting brackets are perpendicularly and symmetrically affixed to the front half of the bottom hexagonal riser plate on the inside of the front half of the bottom hexagonal riser plate;

wherein the pair of back mounting brackets are perpendicularly and symmetrically affixed to the back half of the top hexagonal riser plate on the inside of the top hexagonal riser plate and the pair of back mounting brackets are perpendicularly and symmetrically affixed to the back half of the bottom hexagonal riser plate on the inside of the back half of the bottom hexagonal riser plate;

wherein the top of each pivot bar faces the bottom of the top hexagonal riser plate and the bottom of each pivot bar faces the top of the bottom hexagonal riser plate;

wherein each pivot bar includes a multiplicity of evenly spaced holes disposed between the two sides of each pivot bar;

wherein the first end of each flexible member of the top pair of flexible members is affixed to the front half of the top hexagonal riser plate on the outside of the top hexagonal riser plate;

wherein the first end of each flexible member of the bottom pair of flexible members is affixed to the front half of the bottom hexagonal riser plate on the outside of the bottom hexagonal riser plate;

wherein the cam pulleys are rotationally affixed between the top pair of flexible members and the bottom pair of flexible members via affixation between the second ends of each of the flexible members;

wherein the at least one cable is wrapped around at least a portion of the cam pulleys;

wherein the bowstring is wrapped around at least a portion of the cam pulleys;

wherein the yoke is pivotally mountable between the pair of pivot bars via the multiplicity of evenly spaced holes on each pivot bar such that the handle is adjustable among a plurality of positions via movement of the yoke wherein the multiplicity of evenly spaced holes on each pivot bar includes at least a first hole and a last hole on each pivot bar;

wherein the first hole on each pivot bar is positioned farthest away from the nock point on the bowstring;

wherein the last hole on each pivot bar is positioned closest to the nock point on the bowstring;

wherein the mechanical projectile device provides for a variety of draw lengths via horizontal movement of the yoke between the pair of pivot bars, wherein the variety of draw lengths includes a longest draw length and a shortest draw length;

wherein the longest draw length for the mechanical projectile device is achieved by pivotally mounting the yoke in the first hole on each pivot bar;

wherein the shortest draw length for the mechanical projectile device is achieved by pivotally mounting the yoke in the last hole on each pivot bar; and wherein the arm brace is rotatable about the bottom end of the handle from a home position through a plurality of positions which accommodate left-handedness and right-handedness, wherein when the arm brace is in the home position, the handle, the arm brace, the yoke, and the horizontal structural riser are symmetrical relative to a vertical plane which bisects the handle, the arm brace, the yoke, and the horizontal structural riser.

2. The mechanical projectile device of claim 1, wherein the handle pivots about an axis parallel to the horizontal structural riser.

3. The mechanical projectile device of claim 1, wherein the handle pivots about an axis perpendicular to the horizontal structural riser.

4. The mechanical projectile device of claim 1, wherein the mechanical projectile device weighs less than 3.5 pounds and the length between the second ends of the top pair of flexible members is less than 20 inches.

5. The mechanical projectile device of claim 1, wherein no components of the mechanical projectile device are positioned in a horizontal plane between the pair of pivot bars, such that no components of the mechanical projectile device obstruct horizontal movement of the yoke of the handle among the multiplicity of evenly spaced holes on each pivot bar.

6. The mechanical projectile device of claim 1, wherein the top end of the handle further includes a biaxial gimbal, wherein the biaxial gimbal is connected to the yoke and the biaxial gimbal provides for the handle to rotate with respect to two axes.

7. The mechanical projectile device of claim 1, wherein the top end of the handle further includes a triaxial gimbal, wherein the triaxial gimbal is connected to the yoke and the triaxial gimbal provides for the handle to rotate with respect to three axes.

8. The mechanical projectile device of claim 1, wherein the yoke includes an offset pivot point for pivotally mounting the yoke between the pair of pivot bars, wherein the yoke is forwardly and reversibly mountable between the pair of pivot bars via the offset pivot point, and wherein forwardly mounting the yoke on a selected hole selected out of the multiplicity of evenly spaced holes on each of the pair of pivot bars provides a different draw length from reversibly mounting the yoke on the selected hole selected out of the multiplicity of evenly spaced holes on each of the pair of pivot bars.

9. A mechanical projectile device comprising:

limbs, each limb having a first end and a second end;

a bowstring including a nock point;

a handle including a top end and a bottom end, wherein the top end of the handle has a yoke and the bottom end of the handle is connected to an arm brace; and a horizontal structural riser including:

a pair of pivot bars including a left pivot bar and a right pivot bar, each pivot bar including a top, a bottom, a front end, a back end, and two sides;

a pair of front mounting brackets including a left front mounting bracket and a right front mounting bracket, wherein the front end of the left pivot bar is attached to the left front mounting bracket and the front end of the right pivot bar is attached to the right front mounting bracket;

a pair of back mounting brackets including a left back mounting bracket and a right back mounting bracket, wherein the back end of the left pivot bar is attached to the left mounting bracket and the back end of the right pivot bar is attached to the right mounting bracket;

a top polygonal riser plate having an inside, an outside, a front half, a back half, a top, and a bottom;

a bottom polygonal riser plate having an inside, an outside, a front half, a back half, a top, and a bottom, wherein the bottom polygonal riser plate is parallel to the top polygonal riser plate and the top of the bottom polygonal riser plate faces the bottom of the top polygonal riser plate;

wherein the pair of front mounting brackets are perpendicularly and symmetrically affixed to the front half of the top polygonal riser plate and are perpendicularly and symmetrically affixed to the front half of the bottom polygonal riser plate;

wherein the pair of back mounting brackets are perpendicularly and symmetrically affixed to the back half of the top polygonal riser plate and are perpendicularly and symmetrically affixed to the back half of the bottom polygonal riser plate;

wherein the top of each pivot bar faces the bottom of the top polygonal riser plate and the bottom of each pivot bar faces the top of the bottom polygonal riser plate;

wherein each pivot bar includes a multiplicity of holes disposed between the two sides of each pivot bar;

wherein the first end of each limb is affixed to the front half of the top polygonal riser plate;

wherein the first end of each limb is affixed to the front half of the bottom polygonal riser plate;

wherein the bowstring is attached to the second end of each limb;

wherein the yoke is pivotally mountable between the pair of pivot bars via the multiplicity of holes on each pivot bar such that the mechanical projectile device provides for a variety of draw lengths via horizontal movement and pivotal mounting of the yoke between the pair of pivot bars, wherein the variety of draw lengths includes a longest draw length and a shortest draw length;

wherein the multiplicity of holes on each pivot bar includes at least a first hole and a last hole;

wherein the first hole on each pivot bar is positioned farthest away from the nock point on the bowstring;

wherein the last hole on each pivot bar is positioned closest to the nock point on the bowstring;

wherein the longest draw length for the mechanical projectile device is achieved by pivotally mounting the yoke in the first hole on each pivot bar; and wherein the shortest draw length for the mechanical projectile device is achieved by pivotally mounting the yoke in the last hole on each pivot bar.

10. The mechanical projectile device of claim 9, wherein the handle pivots about an axis parallel to the horizontal structural riser.

11. The mechanical projectile device of claim 9, wherein the handle pivots about an axis perpendicular to the horizontal structural riser.

12. The mechanical projectile device of claim 9, wherein the limbs are split limbs.

13. The mechanical projectile device of claim 9, wherein the limbs are solid limbs.

14. The mechanical projectile device of claim 9, wherein the arm brace is rotatable about the bottom end of the handle from a home position through a plurality of positions which accommodate left-handedness and right-handedness, wherein when the arm brace is in the home position, the handle, the arm brace, the yoke, and the horizontal structural riser are symmetrical relative to a vertical plane which bisects the handle, the arm brace, the yoke, and the horizontal structural riser.

15. The mechanical projectile device of claim 9, wherein the arm brace, the handle, the yoke, and the horizontal structural riser are symmetrical relative to a vertical plane which bisects the handle, the arm brace, the yoke, and the horizontal structural riser such that no adjustments to the arm brace, the handle, the yoke, or the horizontal structural riser are needed to accommodate left-handedness and right-handedness.

16. The mechanical projectile device of claim 9, wherein the yoke includes an offset pivot point for pivotally mounting the yoke between the pair of pivot bars, wherein the yoke is forwardly and reversibly mountable between the pair of pivot bars via the offset pivot point, and wherein forwardly mounting the yoke on a selected hole selected out of the multiplicity of holes on each of the pair of pivot bars provides a different draw length from reversibly mounting the yoke on the selected hole selected out of the multiplicity of holes on each of the pair of pivot bars.

* * * * *